US012331420B2

(12) United States Patent
Shimoyama et al.

(10) Patent No.: US 12,331,420 B2
(45) **Date of Patent: *Jun. 17, 2025**

(54) PLATING APPARATUS AND PLATING METHOD

(71) Applicant: EBARA CORPORATION, Tokyo (JP)

(72) Inventors: Masashi Shimoyama, Tokyo (JP); Yasuyuki Masuda, Tokyo (JP); Ryosuke Hiwatashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/923,163

(22) PCT Filed: Jan. 31, 2022

(86) PCT No.: PCT/JP2022/003526

§ 371 (c)(1),
(2) Date: Nov. 3, 2022

(87) PCT Pub. No.: WO2023/145049

PCT Pub. Date: Aug. 3, 2023

(65) Prior Publication Data

US 2024/0247394 A1 Jul. 25, 2024

(51) Int. Cl.
*C25D 17/00* (2006.01)
*C25D 7/12* (2006.01)

(52) U.S. Cl.
CPC ..... *C25D 17/008* (2013.01); *C25D 7/12* (2013.01); *C25D 17/001* (2013.01)

(58) Field of Classification Search
None
See application file for complete search history.

(56) References Cited

U.S. PATENT DOCUMENTS

| | | | | |
|---|---|---|---|---|
| 6,402,923 | B1 | 6/2002 | Mayer et al. | |
| 2005/0040049 | A1 * | 2/2005 | Volodarsky ..... | C25D 17/10 257/E21.585 |
| 2016/0362809 | A1 | 12/2016 | Graham et al. | |

FOREIGN PATENT DOCUMENTS

| | | | |
|---|---|---|---|
| JP | 6901646 | B1 | 7/2021 |
| JP | 6993537 | B1 | 1/2022 |
| WO | WO 2022/118431 | A1 | 6/2022 |
| WO | WO 2022/137514 | A1 | 6/2022 |

* cited by examiner

*Primary Examiner* — Wojciech Haske
(74) *Attorney, Agent, or Firm* — BakerHostetler

(57) ABSTRACT

A specific portion of a substrate is allowed to be shielded at a desired timing, and making a plating film-thickness uniform is improved.

A plating module includes: a plating tank 410 for housing a plating solution; an anode 430 disposed in the plating tank 410; a substrate holder 440 for holding a substrate Wf with a surface to be plated Wf-a facing downward; a rotation mechanism 447 configured to rotate the substrate holder 440 in a first direction and a second direction opposite to the first direction; and a shielding mechanism 485 configured to move a shielding member 481 into between the anode 430 and the substrate Wf depending on a rotation angle of the substrate holder 440.

7 Claims, 23 Drawing Sheets

1000

(a)

(b)

(a)

(b)

(a)

(b)

PLATING APPARATUS AND PLATING METHOD

TECHNICAL FIELD

This application relates to a plating apparatus and a plating method.

BACKGROUND ART

As an example of a plating apparatus, there has been known a cup type electroplating apparatus. The cup type electroplating apparatus immerses a substrate (for example, semiconductor wafer) held by a substrate holder with a surface to be plated facing downward in a plating solution, and applies a voltage between the substrate and an anode, thereby depositing a conductive film on a surface of the substrate.

It has been known that the cup type electroplating apparatus uses a shielding member to seal an electric field formed between the anode and the substrate. For example, PTL 1 discloses an electroplating apparatus configured to shield a specific portion of a substrate only at a desired timing by moving a shielding member into between the specific portion of the substrate and an anode when the specific portion of the substrate is rotated within a predetermined range of a rotation angle.

CITATION LIST

Patent Literature

PTL 1: Japanese Patent No. 6901646

SUMMARY OF INVENTION

Technical Problem

However, the electroplating apparatus of the prior art is desired to uniform a plating film-thickness by enhancing a stirring strength of a plating solution housed in a plating tank while shielding a specific portion of a substrate at a desired timing.

That is, in the prior art, since a substrate holder is rotated in one direction at a constant rotation speed, a time period of shielding the specific portion of the substrate is fixed. In this respect, for example, when it is desired to shield the specific portion of the substrate for a longer time, it is considered to decrease the rotation speed of the substrate holder while the specific portion of the substrate rotates in a predetermined range of a rotation angle. However, decreasing the rotation speed of the substrate holder reduces the stirring strength of the plating solution housed in the plating tank, and consequently, making the thickness of the plating film formed on a surface to be plated uniform is possibly hindered.

Therefore, this application has an object to achieve a plating apparatus and a plating method allowing to shield a specific portion of a substrate at a desired timing and allowing to improve making a plating film-thickness uniform.

Solution to Problem

According to one embodiment, a plating apparatus is disclosed. The plating apparatus includes: a plating tank for housing a plating solution; an anode disposed in the plating tank; a substrate holder for holding a substrate with a surface to be plated facing downward; a rotation mechanism configured to rotate the substrate holder in a first direction and a second direction opposite to the first direction; and a shielding mechanism configured to move a shielding member into between the anode and the substrate depending on a rotation angle of the substrate holder.

DESCRIPTION OF EMBODIMENTS

Figure 1:
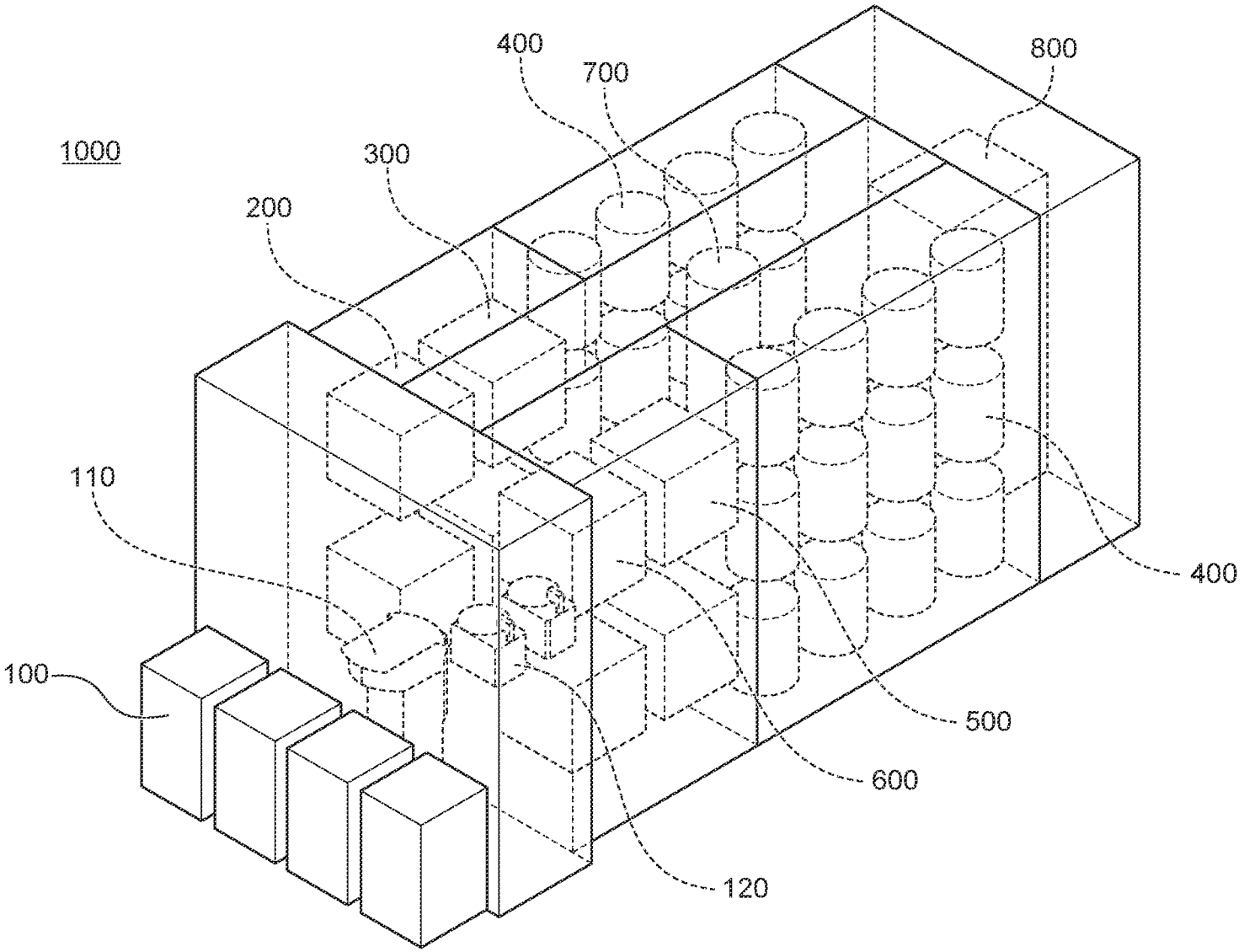
FIG. 1 is a perspective view illustrating an overall configuration of a plating apparatus of the embodiment.

The following describes embodiments of the present invention with reference to the drawings. In the drawings described below, identical reference numerals are attached to identical or equivalent components, and overlapping description will be omitted.

<Overall Configuration of Plating Apparatus>

Figure 2:
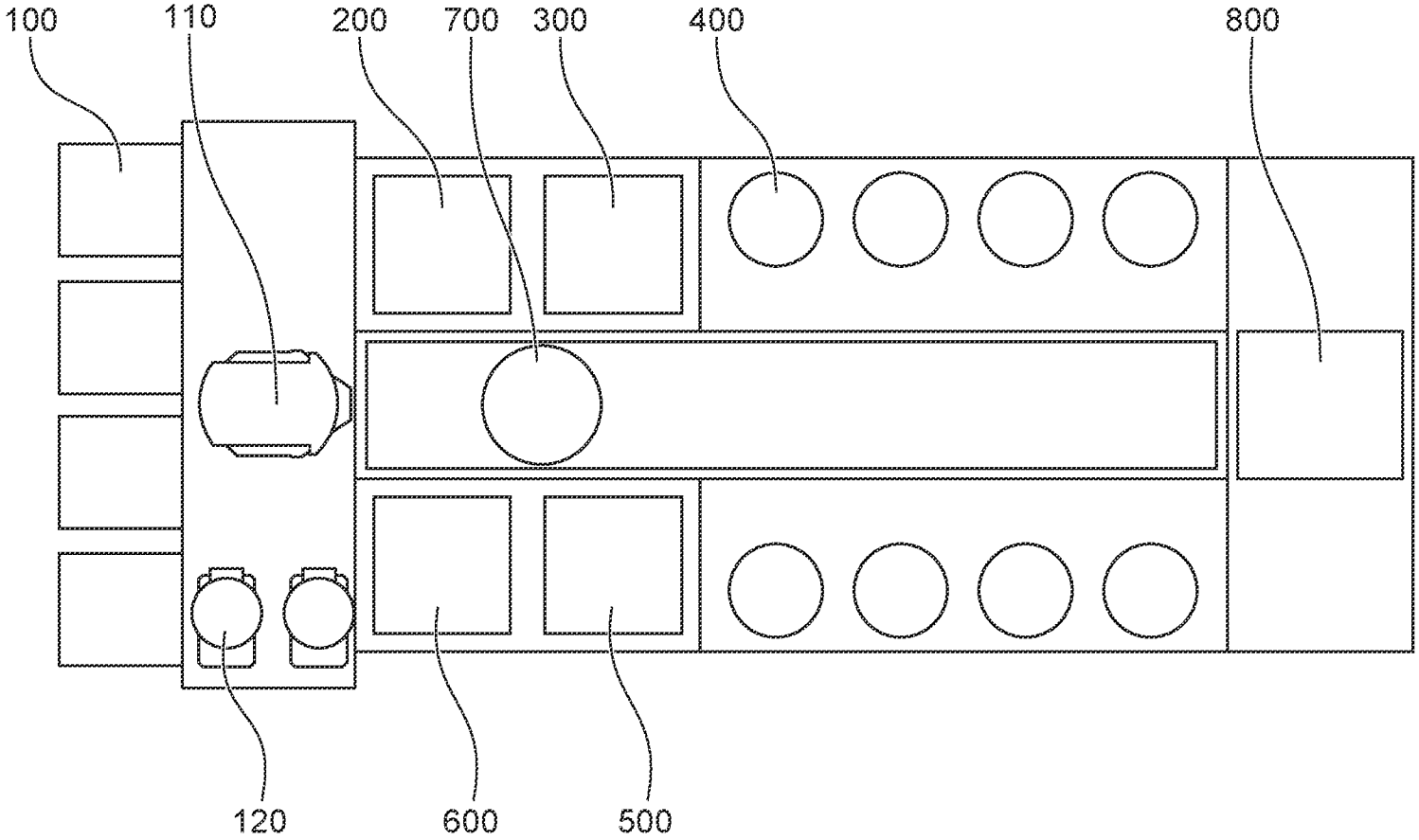
FIG. 2 is a plan view illustrating the overall configuration of the plating apparatus of the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

<Configuration of Plating Module>

Figure 3:
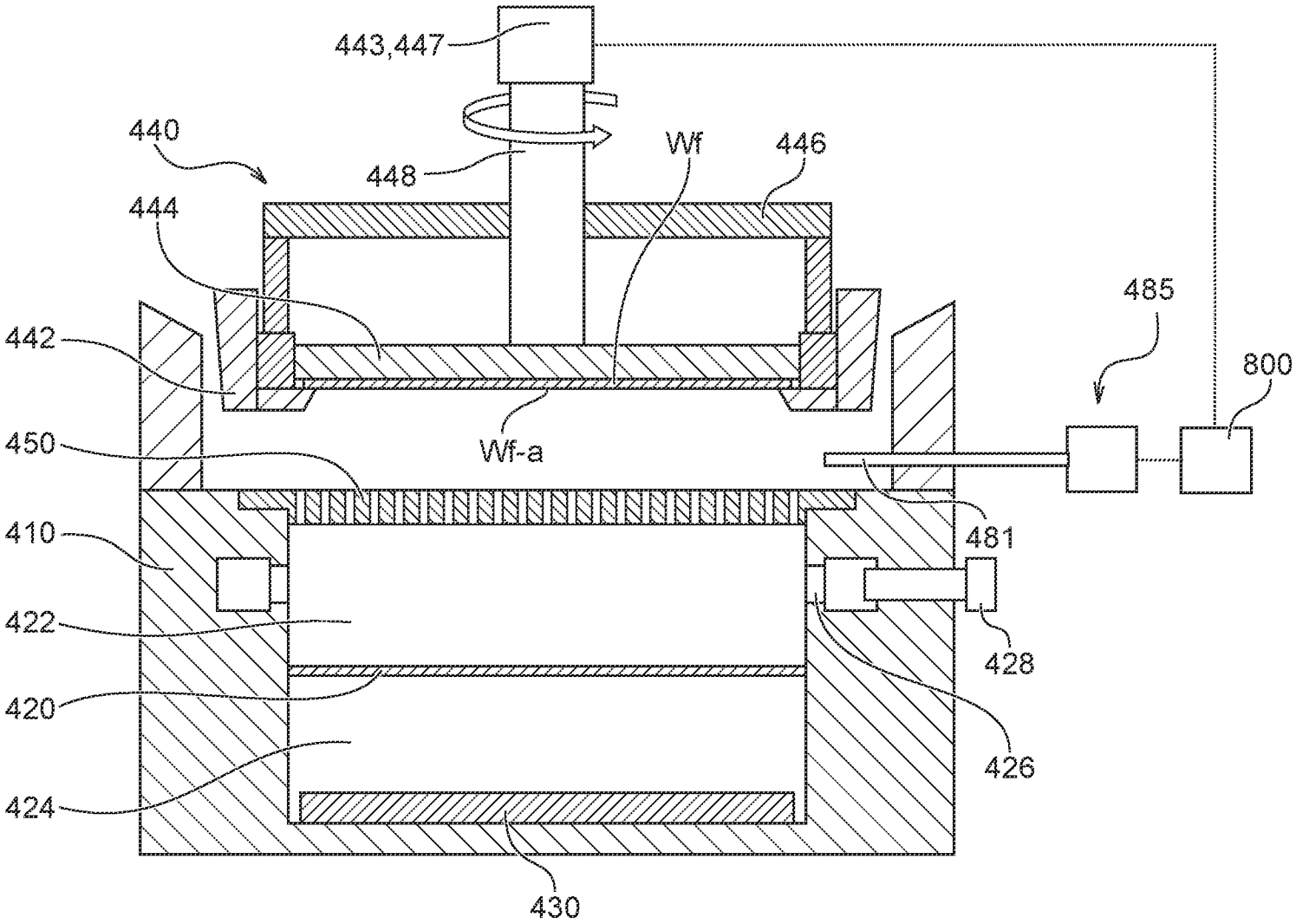
FIG. 3 is a vertical cross-sectional view schematically illustrating a configuration of a plating module of one embodiment, and illustrates a state where a shielding member is moved to a retracted position.
Figure 4:
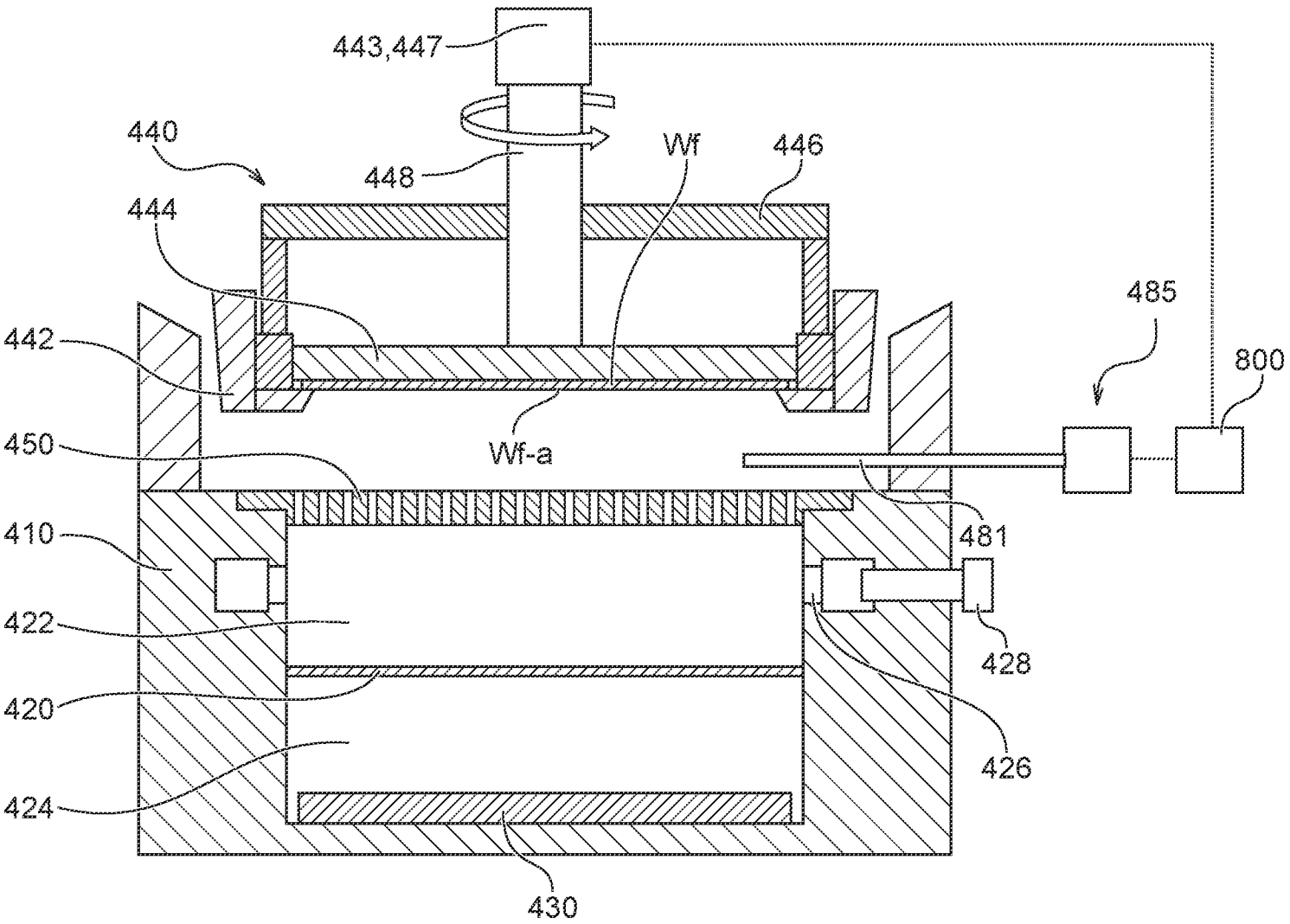
FIG. 4 is a vertical cross-sectional view schematically illustrating the configuration of the plating module of one embodiment, and illustrates a state where the shielding member is moved to a shielding position.

Next, the configuration of the plating module 400 will be described. Since the 24 plating modules 400 according to the embodiment have the same configuration, only one of the plating modules 400 will be described. FIG. 3 is a vertical cross-sectional view schematically illustrating a configuration of a plating module of one embodiment, and illustrates a state where a shielding member is moved to a position (referred to as a "retracted position" as necessary) apart from between an anode and a substrate. FIG. 4 is a vertical cross-sectional view schematically illustrating the configuration of the plating module of one embodiment, and illustrates a state where the shielding member is moved to a position (referred to as a "shielding position" as necessary) between the anode and the substrate.

As illustrated in FIG. 3 and FIG. 4, the plating module 400 includes a plating tank 410 for housing a plating solution. The plating module 400 includes a membrane 420 dividing inside the plating tank 410 in the vertical direction. The inside of the plating tank 410 is divided into a cathode region 422 and an anode region 424 by the membrane 420.

The cathode region 422 and the anode region 424 are each filled with the plating solution. The plating module 400 includes a nozzle 426 opening toward the cathode region 422, and a supply source 428 for supplying the plating solution to the cathode region 422 via the nozzle 426. For the anode region 424 as well, the plating module 400 includes a mechanism for supplying the plating solution to the anode region 424, but it is not illustrated. An anode 430 is disposed on a bottom surface of the plating tank 410 in the anode region 424. An ionically resistive element 450 is disposed to be opposed to the membrane 420 in the cathode region 422. The ionically resistive element 450 is a member for attempting to uniformize a plating process on a surface to be plated Wf-a of a substrate Wf, and is configured of a plate-shaped member provided with many holes.

Further, the plating module 400 includes a substrate holder 440 for holding the substrate Wf with the surface to be plated Wf-a facing downward. The substrate holder 440 includes a power feeding contact point (not illustrated) for feeding power from a power source to the substrate Wf. The substrate holder 440 includes a seal ring holder 442 for supporting an outer edge portion of the surface to be plated Wf-a of the substrate Wf and a frame 446 for holding the seal ring holder 442 to a substrate holder main body (not illustrated). Further, the substrate holder 440 includes a back plate 444 for pressing a back surface of the surface to be plated Wf-a of the substrate Wf and a shaft 448 attached to a back surface of a substrate pressing surface of the back plate 444.

The plating module 400 includes an elevating mechanism 443 for moving up and down the substrate holder 440 and a rotation mechanism 447 for rotating the substrate holder 440 so that the substrate Wf rotates about a virtual axis (virtual rotation axis extending perpendicularly in a center of the surface to be plated Wf-a) of the shaft 448. The rotation mechanism 447 is configured to rotate the substrate holder 440 in a first direction (for example, clockwise) and a second direction (counterclockwise) opposite to the first direction. In other words, the rotation mechanism 447 can rotate the substrate holder 440 in the first direction, and can rotate the substrate holder 440 in the second direction by switching the rotation direction. The elevating mechanism 443 and the rotation mechanism 447 can be achieved by a known mechanism, such as a motor. The plating module 400 is configured to perform the plating process on the surface to be plated Wf-a of the substrate Wf by immersing the substrate Wf in the plating solution in the cathode region 422 using the elevating mechanism 443 and applying a voltage between the anode 430 and the substrate Wf.

The plating module 400 includes a shielding member 481 for shielding an electric field formed between the anode 430 and the substrate Wf when the shielding member 481 is arranged between the anode 430 and the substrate Wf. The shielding member 481 may be, for example, a shielding plate formed in a plate shape. The plating module 400 includes a shielding mechanism 485 for moving the shielding member 481. The shielding mechanism 485 is configured to operate in response to a command signal based on information regarding a rotation angle of the substrate holder 440 input from the control module 800. Specifically, the shielding mechanism 485 is configured to move the shielding member 481 to the retracted position as illustrated in FIG. 3 when the rotation angle of a specific portion of the substrate Wf is out of a predetermined range. Further, the shielding mechanism 485 is configured to move the shielding member 481 to the shielding position as illustrated in FIG. 4 when the rotation angle of the specific portion of the substrate Wf is within the predetermined range. That is, the shielding mechanism 485 is configured to linearly move the shielding member 481 between the retracted position and the shielding position depending on the rotation angle of the substrate holder 440. The following describes a specific example of the shielding mechanism 485.

Figure 5:
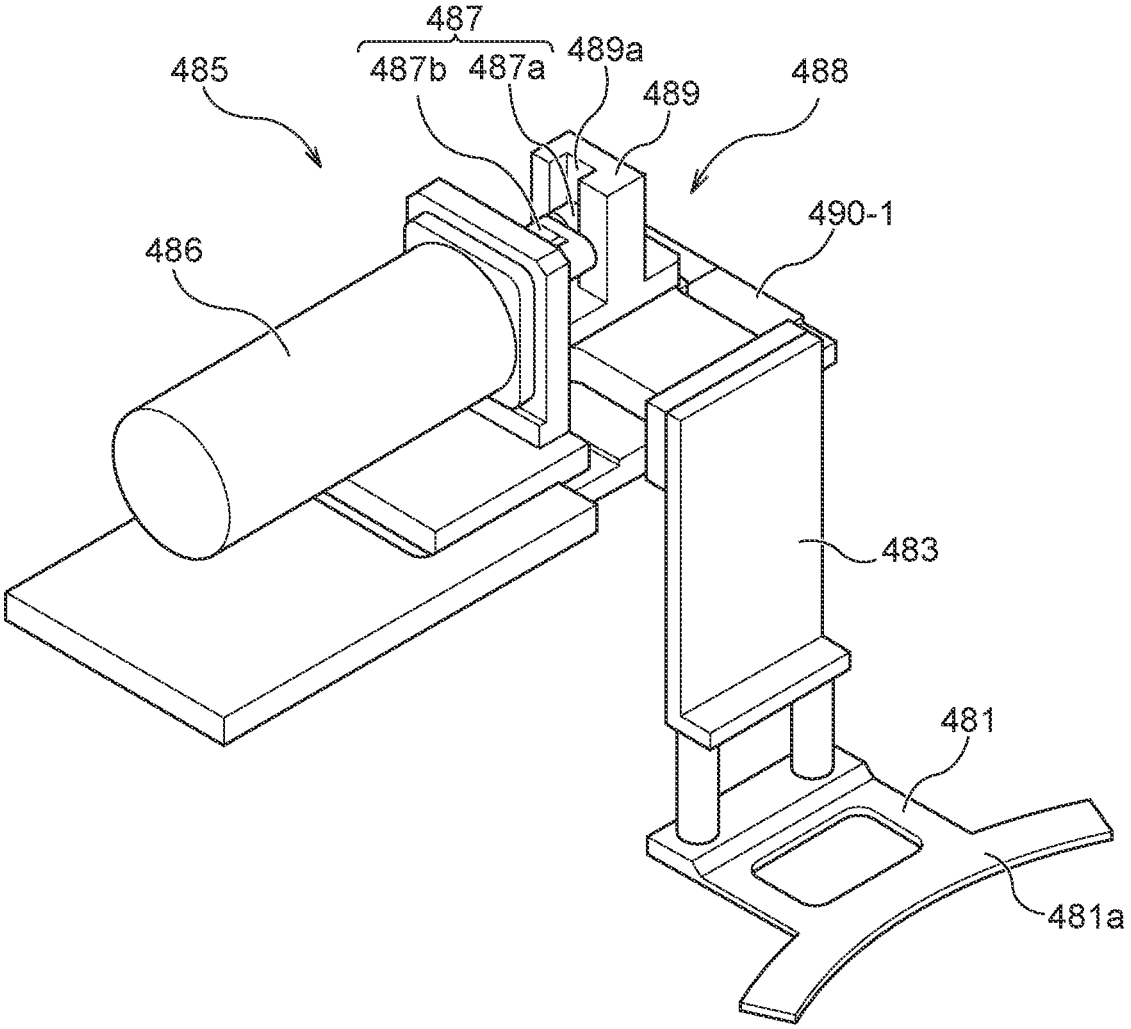
FIG. 5 is a perspective view schematically illustrating a configuration of a shielding mechanism of one embodiment.
Figure 6:
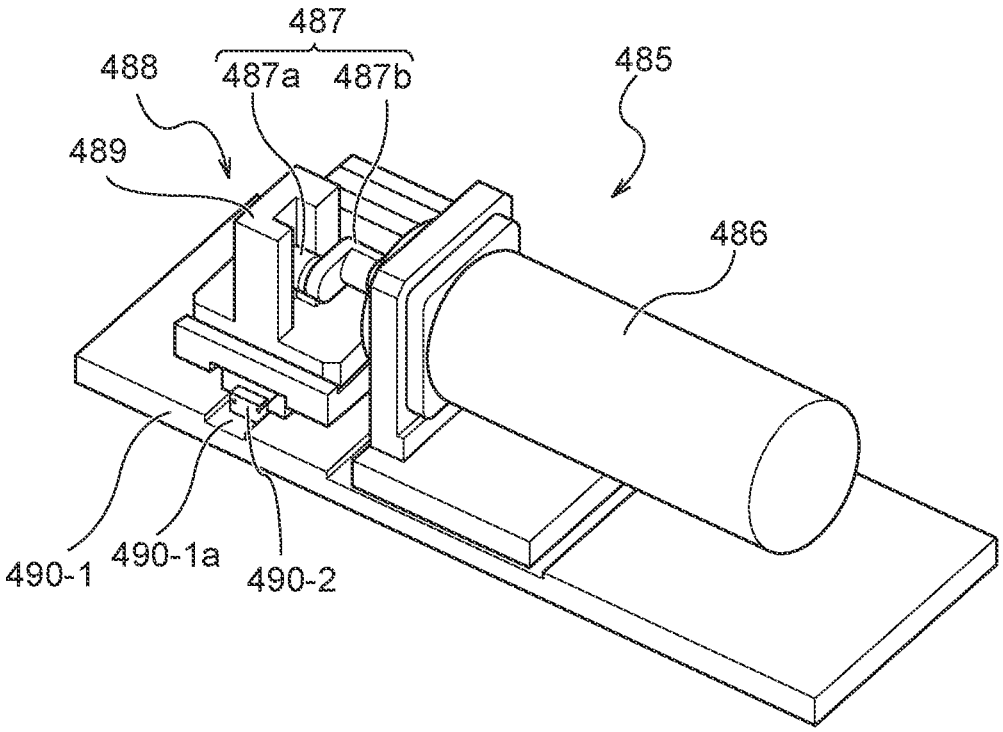
FIG. 6 is a perspective view schematically illustrating the configuration of the shielding mechanism of one embodiment.
Figure 7:
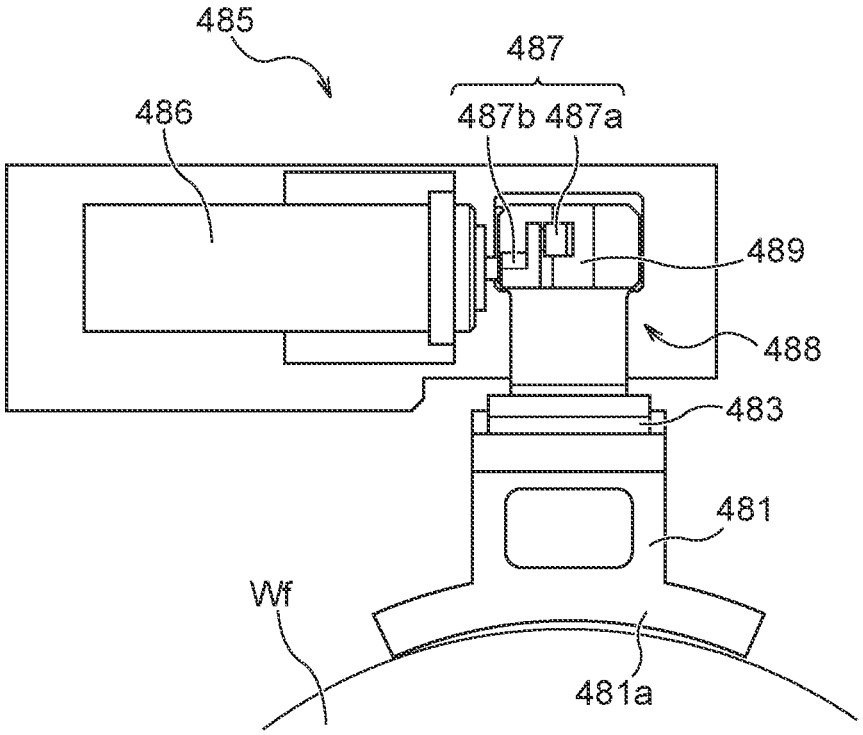
FIG. 7 includes plan views schematically illustrating the configuration of the shielding mechanism of one embodiment.
Figure 7:
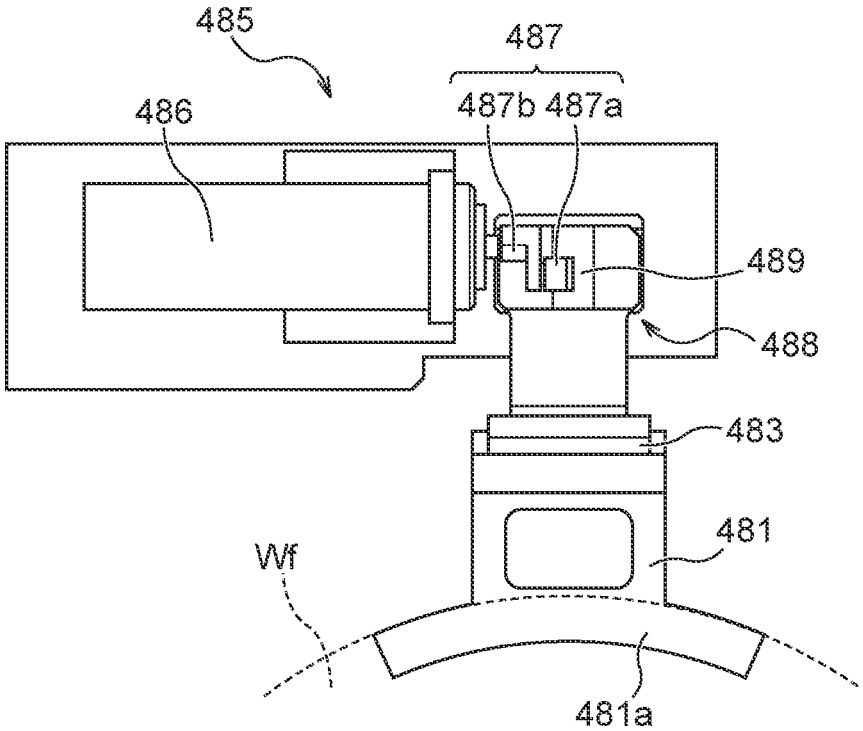

FIG. 5 is a perspective view schematically illustrating a configuration of a shielding mechanism of one embodiment. FIG. 6 is a perspective view schematically illustrating the configuration of the shielding mechanism of one embodiment. FIG. 7 includes plan views schematically illustrating the configuration of the shielding mechanism of one embodiment. FIG. 7A illustrates a state where the shielding member 481 is at the retracted position, and FIG. 7B illustrates a state where the shielding member 481 is at the shielding position.

As illustrated in FIG. 5 to FIG. 7, the shielding mechanism 485 includes a cam member 487, a rotation drive mechanism 486 configured to rotate the cam member 487, and a driven member 488 configured to linearly move the shielding member 481 between the shielding position and the retracted position in association with a rotation of the cam member 487. The rotation drive mechanism 486 can be achieved by a known mechanism, such as a rotation motor.

The cam member 487 has a cam main body 487*b* configured to rotate by the rotation drive mechanism 486 and a rotor 487*a* attached to the cam main body 487*b*. The rotor 487*a* is attached to the cam main body 487*b* at a position eccentric with respect to a rotation axis of the rotation drive mechanism 486.

The driven member 488 includes a driven slider 489 arranged on a pedestal 490-1 and a linear motion guide 490-2 configured to guide the driven slider 489. On an upper surface of the pedestal 490-1, a groove 490-1*a* is formed along a direction identical to a linear motion direction between the shielding position and the retracted position of the shielding member 481. The driven slider 489 is arranged on the pedestal 490-1 via the linear motion guide 490-2 arranged in the groove 490-1*a*. The linear motion guide 490-2 is configured to guide the driven slider 489 along the groove 490-1*a*. This allows the driven slider 489 to reciprocate in the direction of the groove 490-1*a*. The driven slider 489 is arranged being opposed to the rotation drive mechanism 486 across the cam member 487. On an opposed surface of the driven slider 489 to the rotation drive mechanism 486, a cam groove 489*a* is formed along a vertical direction. The rotor 487*a* of the cam member 487 is fitted in the cam groove 489*a*. The shielding member 481 is attached to the driven slider 489 via a plate-shaped bracket 483 extending in the vertical direction.

When the rotation drive mechanism 486 rotates the cam member 487 (cam main body 487*b*), the rotor 487*a* rotates about the rotation axis of the rotation drive mechanism 486. At this time, the rotor 487*a* presses a side surface of the cam groove 489*a*. This causes the driven slider 489 to move along the groove 490-1*a*. When the cam member 487 is rotated through a half turn (180 degree turn) from the state (retracted position) illustrated in FIG. 5 and FIG. 6, the driven slider 489 moves the shielding member 481 to the shielding position. When the rotation drive mechanism 486 stops the rotation of the cam member 487 in this state, the shielding member 481 remains to be moved to the shielding position. Meanwhile, when the rotation drive mechanism 486 further rotates the cam member 487 through a half turn (180 degree turn) from this state, the driven slider 489 moves the shielding member 481 to the retracted position. That is, the driven slider 489 can linearly move the shielding member 481 between the shielding position and the retracted position by reciprocating along the groove 490-1*a* in association with the rotation of the cam member 487.

The rotation drive mechanism 486 is configured to rotate the cam member 487 depending on the rotation angle of the substrate holder 440. That is, the rotation drive mechanism 486 can rotate the cam member 487 so as to push out the shielding member 481 to the shielding position when the specific portion of the substrate Wf rotates within the predetermined angle range.

Figure 8:
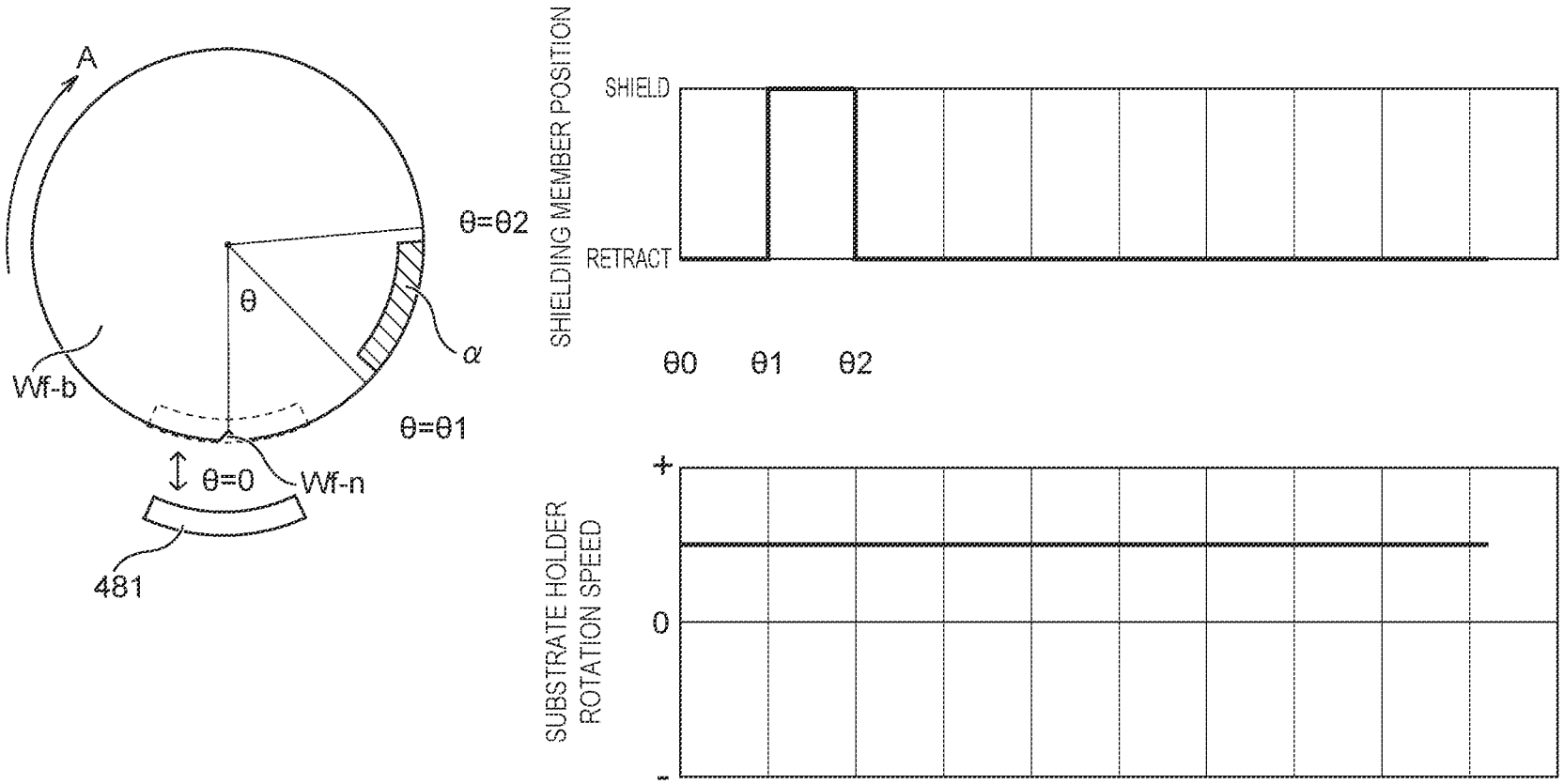
FIG. 8 is a drawing illustrating a relation between a timing of shielding a specific portion of a substrate and a rotation speed of a substrate holder.

FIG. 8 is a drawing illustrating a relation between a timing of shielding a specific portion of a substrate and a rotation speed of a substrate holder. The horizontal axis of the graph of FIG. 8 indicates a rotation position of the specific portion of the substrate Wf, and the vertical axis indicates the position (shielding position or retracted position) of the shielding member and the rotation speed (rotation direction) of the substrate holder 440. FIG. 8 illustrates the position of the shielding member and the rotation speed of the substrate holder when the substrate holder is rotated in the first direction (clockwise) at a constant speed. As illustrated in FIG. 8, the substrate Wf is provided with a notch (cutout) Wf-n. In this example, as illustrated in FIG. 8, assume that a specific portion α in which a deposition rate of plating is to be suppressed is present in a peripheral edge portion within a range of from θ=θ1 to θ=θ2 when the position of the notch Wf-n is a reference (θ=0). Additionally, assume that the substrate Wf is arranged such that the notch Wf-n overlaps with the center of the shielding member 481 as illustrated in FIG. 8 in an initial state of starting the plating process, and starts rotating from the state. The specific portion α, θ1, and θ2 can be determined based on the shape of the shielding member 481, the shape of the specific portion α, and an intensity necessary for suppressing the deposition rate of plating. Therefore, in the relation between θ1, θ2 and the specific portion α, θ1, θ2 may be in the specific portion α, may be on a boundary of the specific portion α, and may be apart from the specific portion α.

The rotation mechanism 447 rotates the substrate holder 440 in the first direction at a predetermined speed as indicated by an arrow A in FIG. 8. The shielding mechanism 485 (rotation drive mechanism 486) pushes out the shielding member 481 to the shielding position when the position of θ1 of the substrate Wf reaches the center of the shielding member 481 (when the rotation angle of the substrate holder 440 or the specific portion α is θ1). Subsequently, the shielding mechanism 485 (rotation drive mechanism 486) pushes back the shielding member 481 to the retracted position when the position of θ2 of the substrate Wf reaches the center of the shielding member 481 (when the rotation angle of the specific portion α is θ2). Thus, the shielding mechanism 485 is configured to move the shielding member 481 between the anode 430 and the specific portion α of the substrate Wf when the rotation angle of the specific portion α of the substrate Wf is within a range of from θ1 to θ2.

According to the embodiment, the specific portion α of the substrate Wf can be covered with the shielding member 481 at a desired timing. That is, according to the embodiment, since the specific portion α can be covered with the shielding member 481 at the desired timing instead of constantly covering the specific portion α with the shielding member 481, an electric field in the specific portion α can be appropriately suppressed, and consequently, the deposition rate of plating in the specific portion α can be suppressed. While an example in which the specific portion α is covered with the shielding member 481 when the rotation angle of the specific portion α is within the predetermined range is described in this embodiment, it is not limited to this. For example, when the deposition rate of plating in the specific portion α is to be increased, the shielding member 481 can be retracted when the rotation angle of the specific portion α is within a predetermined range, and the shielding member 481 can be moved to the shielding position when the rotation angle of the specific portion α is out of the predetermined range.

As illustrated in FIG. 7 and the like, the shielding member 481 includes an arc-shaped mask member 481*a* corresponding to a part of the peripheral edge portion of the circular plate-shaped substrate Wf. Since the specific portion α is formed in an arc shape at the peripheral edge portion of the substrate Wf in some cases, only the specific portion α can be appropriately covered by covering the specific portion α of the substrate Wf using the arc-shaped mask member 481*a*. The same applies to embodiments below.

Additionally, in this embodiment, the rotation mechanism 447 is configured to switch the rotation direction of the substrate holder 440 between the first direction and the second direction when the rotation angle of the specific portion α of the substrate Wf is within a predetermined range (from θ1 to θ2).

Figure 9:
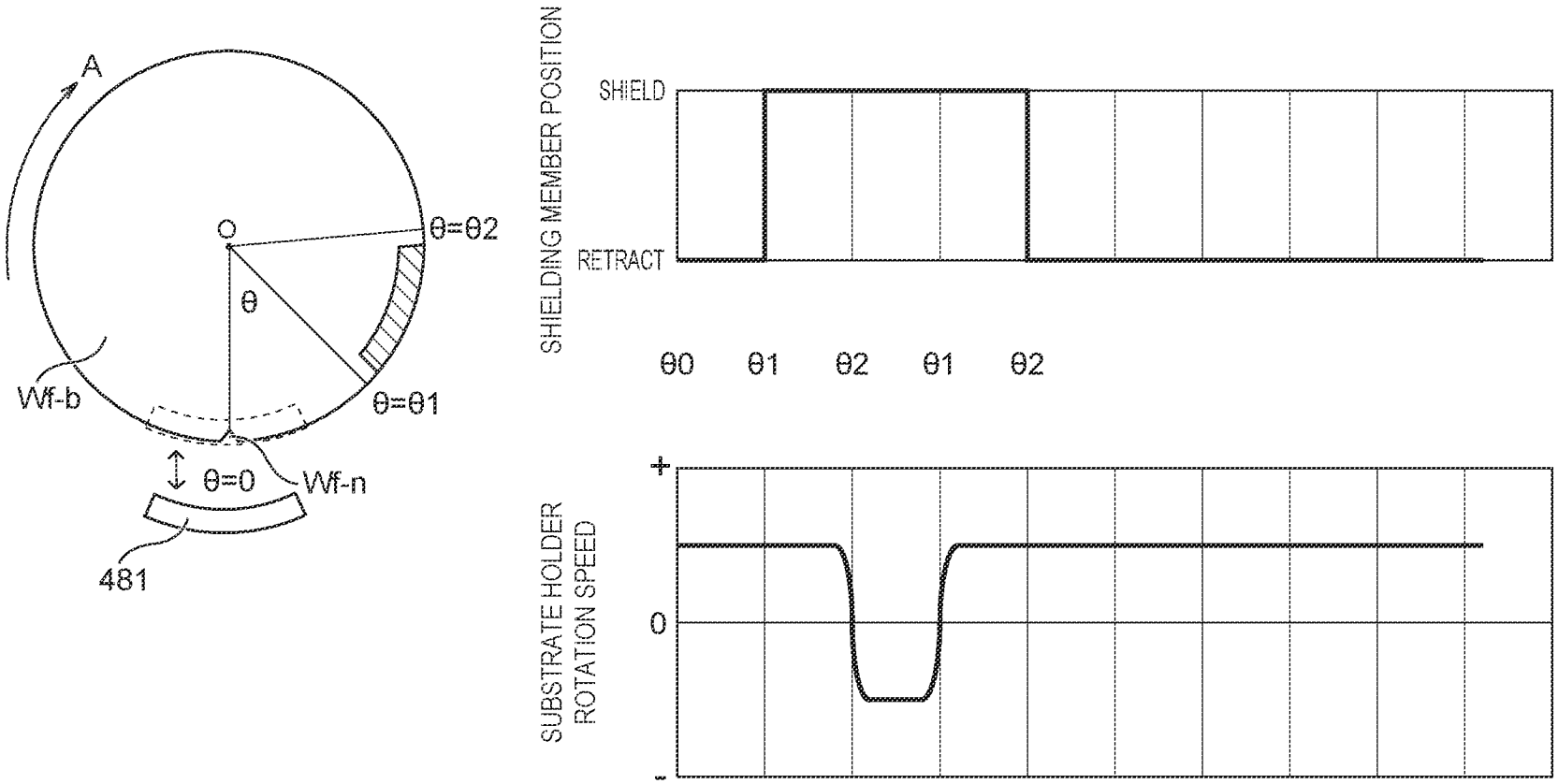
FIG. 9 is a drawing illustrating a relation between the timing of shielding the specific portion of the substrate and the rotation speed of the substrate holder.

FIG. 9 is a drawing illustrating a relation between the timing of shielding the specific portion of the substrate and the rotation speed of the substrate holder. The horizontal axis of the graph of FIG. 9 indicates the rotation position of the specific portion of the substrate Wf, and the vertical axis indicates the position of the shielding member (shielding position or retracted position) and the rotation speed (rotation direction) of the substrate holder 440. FIG. 9 illustrates the position of the shielding member and the rotation speed of the substrate holder when an additional suppression of the deposition rate of plating in the specific portion α of the substrate Wf is performed once (the rotation direction of the substrate holder is switched twice). As illustrated in FIG. 9, the rotation mechanism 447 rotates the substrate holder 440 in the first direction at a predetermined speed at first as indicated by an arrow A in FIG. 9. Subsequently, the rotation mechanism 447 pushes out the shielding member 481 to the shielding position when the position of θ1 of the substrate Wf reaches the center of the shielding member 481 (when the rotation angle of the specific portion α is θ1). Subsequently, the shielding mechanism 485 (rotation drive mechanism 486) switches the rotation direction of the substrate holder 440 to rotate the substrate holder 440 in the second direction when the position of θ2 of the substrate Wf reaches the center of the shielding member 481 (when the rotation angle of the specific portion α is θ2). Subsequently, the rotation mechanism 447 switches the rotation direction of the substrate holder 440 to rotate the substrate holder 440 in the first direction when the position of θ1 of the substrate Wf reaches the center of the shielding member 481 (when the rotation angle of the specific portion α is θ1).

The shielding mechanism 485 (rotation drive mechanism 486) switches the rotation direction of the substrate holder 440, thereby allowing pushing out the shielding member 481 to the shielding position for a period of about three times as illustrated in FIG. 9 compared with a case where the substrate holder 440 is rotated in the first direction at the constant speed.

Accordingly, with the embodiment, the electric field in the specific portion α of the substrate Wf can be strongly suppressed. Additionally, according to the embodiment, since the stirring strength of the plating solution housed in the plating tank 410 can be enhanced by rotating the substrate holder 440 in the opposite direction, making the plating film-thickness uniform can be improved.

Figure 10:
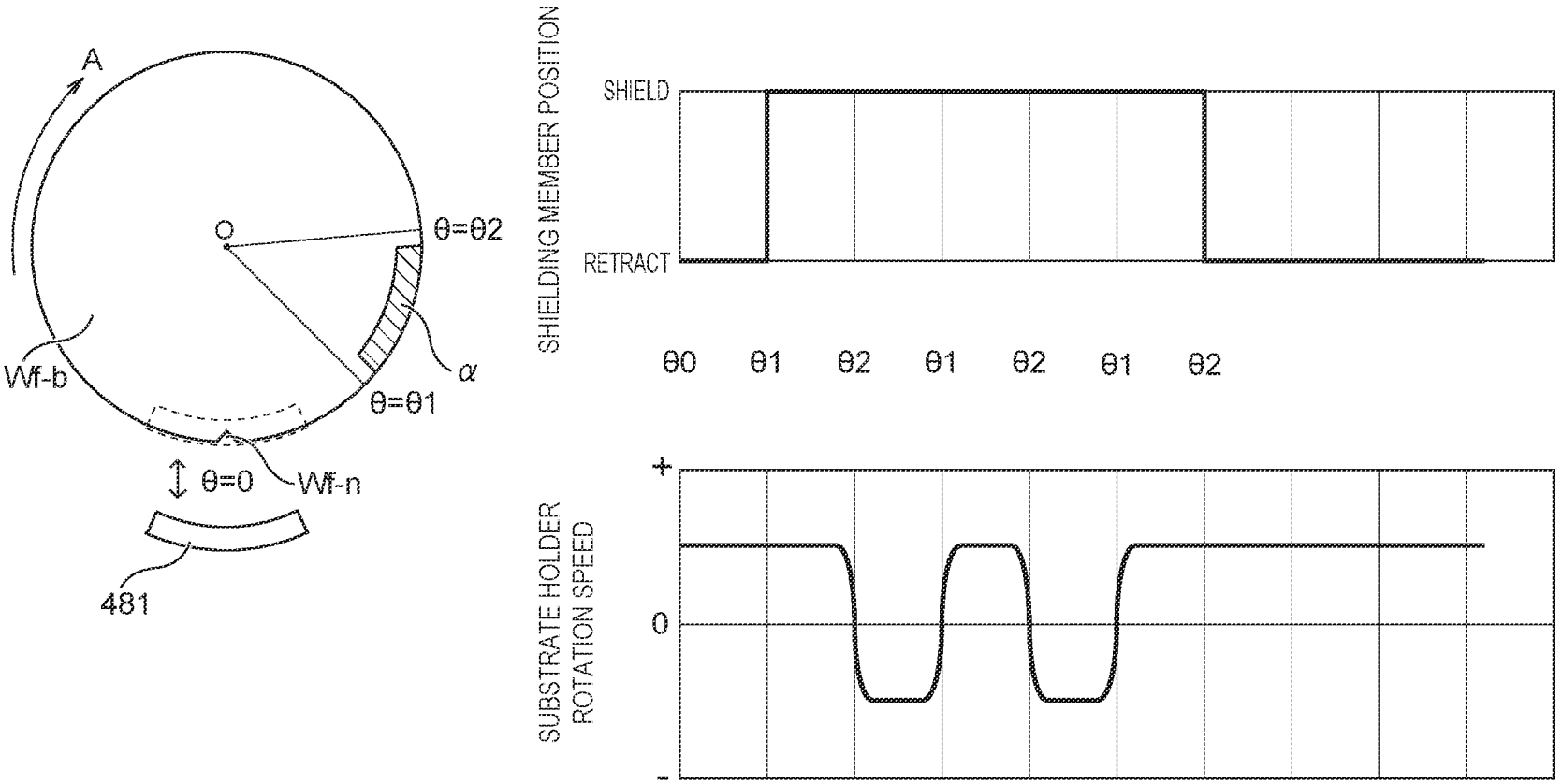
FIG. 10 is a drawing illustrating a relation between the timing of shielding the specific portion of the substrate and the rotation speed of the substrate holder.

FIG. 10 is a drawing illustrating a relation between the timing of shielding the specific portion of the substrate and the rotation speed of the substrate holder. The horizontal axis of the graph of FIG. 10 indicates the rotation position of the specific portion of the substrate Wf, and the vertical axis indicates the position of the shielding member (shielding position or retracted position) and the rotation speed (rotation direction) of the substrate holder 440. FIG. 10 illustrates the position of the shielding member and the rotation speed of the substrate holder when an additional suppression of the deposition rate of plating in the specific portion α of the substrate Wf is performed twice (the rotation direction of the substrate holder is switched four times). As illustrated in FIG. 10, the rotation mechanism 447 rotates the substrate holder 440 in the first direction at a predetermined speed at first as indicated by an arrow A in FIG. 10. Subsequently, the rotation mechanism 447 pushes out the shielding member 481 to the shielding position when the position of θ1 of the substrate Wf reaches the center of the shielding member 481 (when the rotation angle of the specific portion α is θ1). Subsequently, the shielding mechanism 485 (rotation drive mechanism 486) switches the rotation direction of the substrate holder 440 to rotate the substrate holder 440 in the second direction when the position of θ2 of the substrate Wf reaches the center of the shielding member 481 (when the rotation angle of the specific portion α is θ2). Subsequently, the rotation mechanism 447 switches the rotation direction of the substrate holder 440 to rotate the substrate holder 440 in the first direction when the position of θ1 of the substrate Wf reaches the center of the shielding member 481 (when the rotation angle of the specific portion α is θ1).

Subsequently, the rotation mechanism 447 switches the rotation direction of the substrate holder 440 to rotate the substrate holder 440 in the second direction when the position of θ2 of the substrate Wf reaches the center of the shielding member 481 (when the rotation angle of the specific portion α is θ2). Subsequently, the rotation mechanism 447 switches the rotation direction of the substrate holder 440 to rotate the substrate holder 440 in the first direction when the position of θ1 of the substrate Wf reaches the center of the shielding member 481 (when the rotation angle of the specific portion α is θ1).

The shielding mechanism 485 (rotation drive mechanism 486) switches the rotation direction of the substrate holder 440, thereby allowing pushing out the shielding member 481 to the shielding position for a period of about five times as illustrated in FIG. 10 compared with a case where the substrate holder 440 is rotated only in the first direction at the constant speed.

Accordingly, with the embodiment, the electric field in the specific portion α of the substrate Wf can be further strongly suppressed. Additionally, according to the embodiment, since the stirring strength of the plating solution housed in the plating tank 410 can be enhanced by repeatedly rotating the substrate holder 440 in the opposite direction, making the plating film-thickness uniform can be improved.

While the case where the additional suppression of the deposition rate of plating in the specific portion α of the substrate Wf is performed once or twice (the rotation direction of the substrate holder is switched twice or four times) is described in the above-described embodiment, the number of suppression of the deposition rate of plating in the specific portion α (the number of switching of the rotation direction of the substrate holder) can be appropriately set depending on the degree of suppressing the electric field in the specific portion of the substrate. While an example of the case where one specific portion α is provided to the substrate is described in the above-described embodiment, it is not limited to this, and a plurality of specific portions may be provided. In this case, the shielding mechanism 485 can move the shielding member 481 to the shielding position when the rotation angle is within the predetermined range for each of the plurality of specific portions. The rotation mechanism 447 can switch the rotation direction of the substrate holder 440 between the first direction and the second direction when the rotation angle is within the predetermined range for each of the plurality of specific portions.

While the example in which the rotation mechanism 447 switches the rotation direction of the substrate holder 440 when the rotation angle of the specific portion of the substrate Wf is within the predetermined range is described in the above-described embodiment, it is not limited to this. For example, the rotation mechanism 447 can switch the rotation direction of the substrate holder 440 when the rotation angle of the specific portion of the substrate Wf is out of the predetermined range. That is, when the electric field in the specific portion of the substrate Wf is to be suppressed, the rotation mechanism 447 can switch the rotation direction of the substrate holder 440 so as to lengthen the period in which the rotation angle of the specific portion of the substrate Wf is within the predetermined range. On the other hand, when the deposition rate of plating in the specific portion of the substrate Wf is to be increased, the rotation mechanism 447 can switch the rotation direction of the substrate holder 440 so as to shorten the period in which the rotation angle of the specific portion of the substrate Wf is within the predetermined range.

While the example in which the shielding mechanism 485 includes the cam member 487, the rotation drive mechanism 486, the driven member 488, and the like is described in the above-described embodiment, it is not limited to this. The following describes other embodiments of the shielding mechanism 485.

Figure 11:
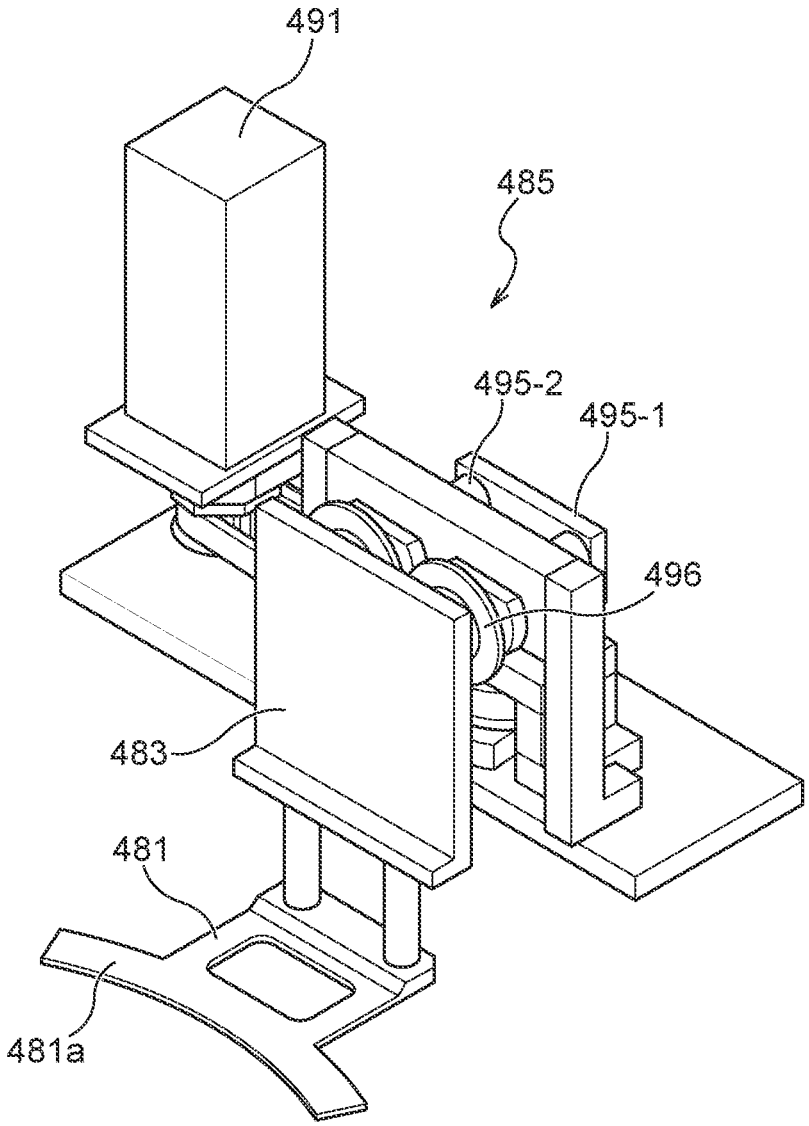
FIG. 11 is a perspective view schematically illustrating a configuration of a shielding mechanism of one embodiment.
Figure 12:
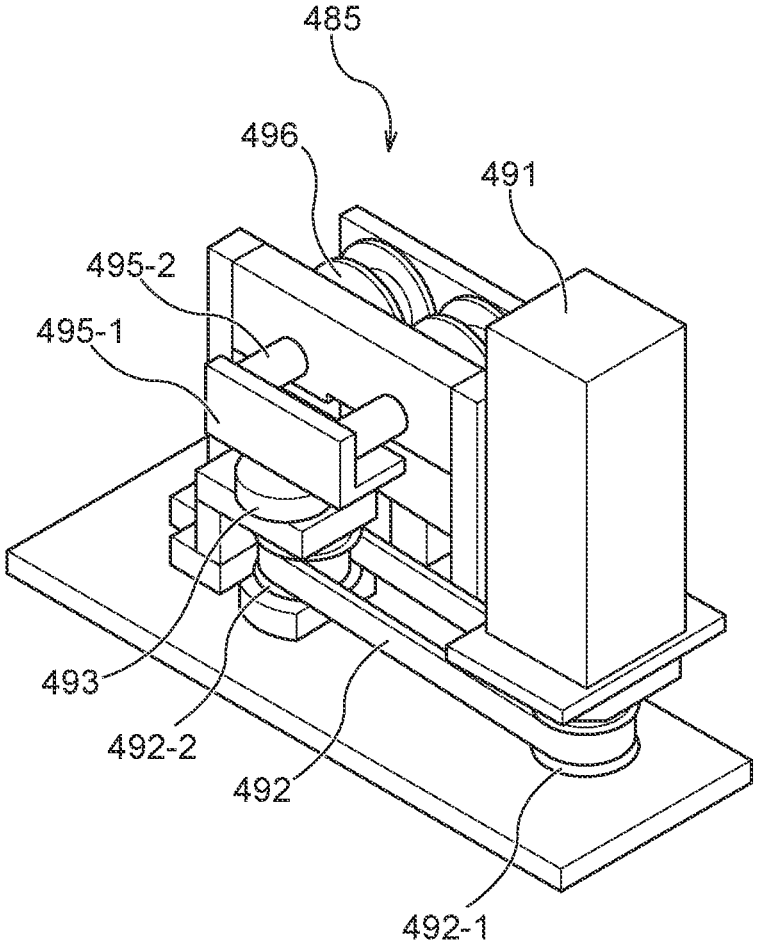
FIG. 12 is a perspective view schematically illustrating the configuration of the shielding mechanism of one embodiment.
Figure 13:
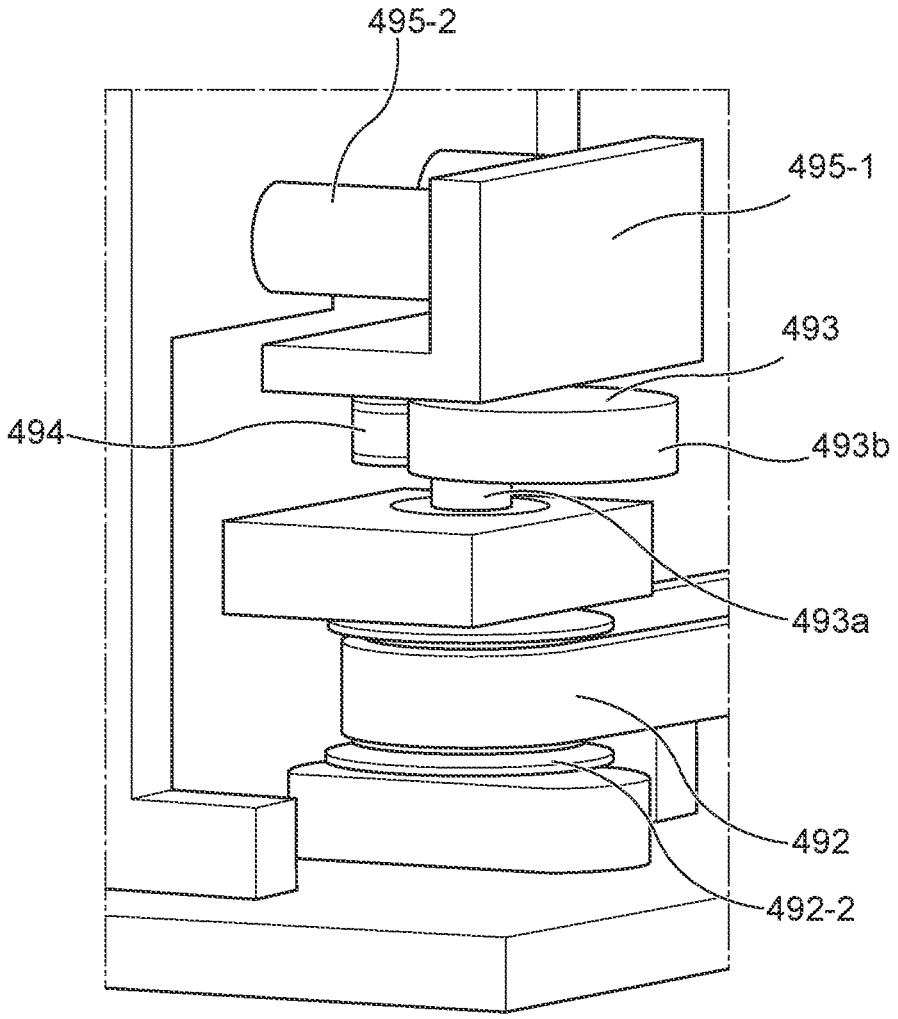
FIG. 13 is a perspective view schematically illustrating a part of the configuration of the shielding mechanism of one embodiment.
Figure 14:
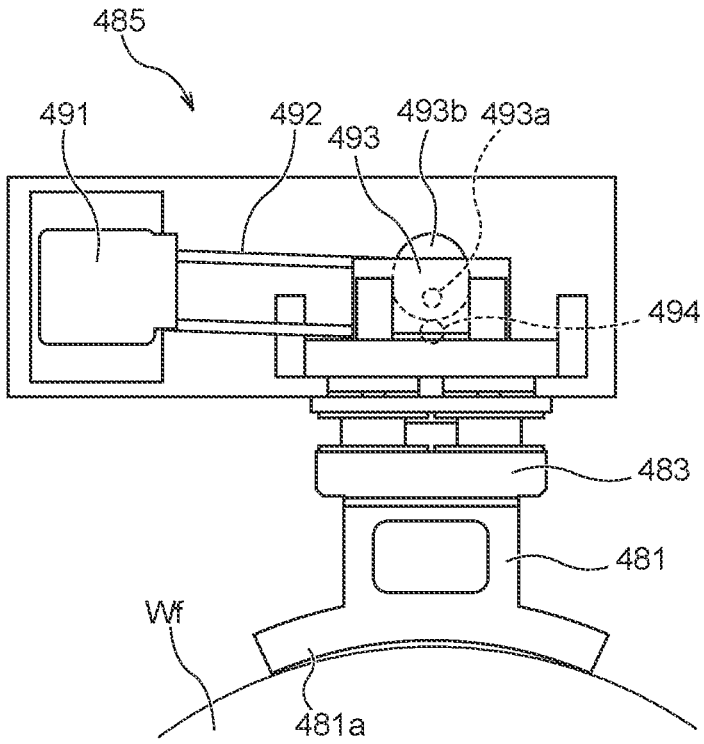
FIG. 14 includes plan views schematically illustrating the configuration of the shielding mechanism of one embodiment.
Figure 14:
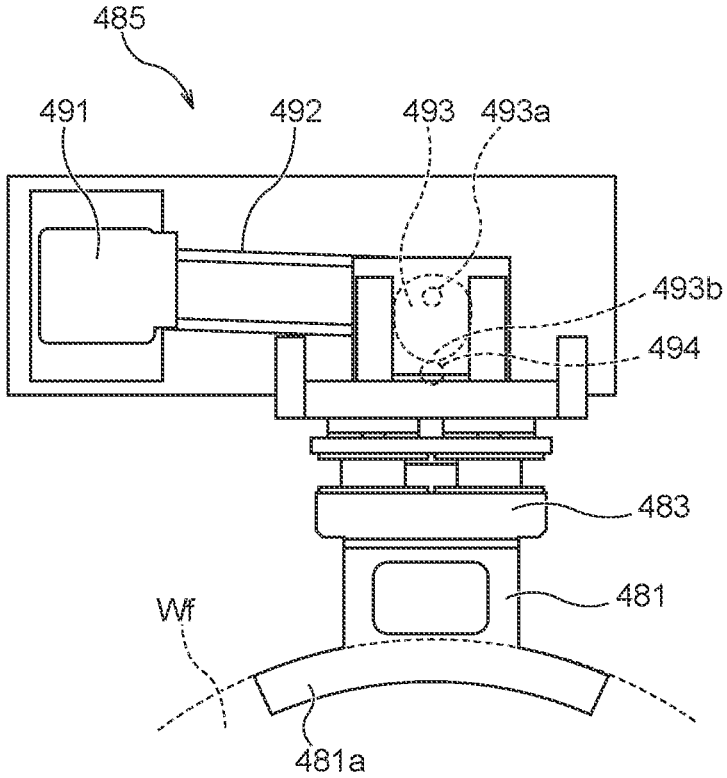

FIG. 11 is a perspective view schematically illustrating a configuration of a shielding mechanism of one embodiment. FIG. 12 is a perspective view schematically illustrating the configuration of the shielding mechanism of one embodiment. FIG. 13 is a perspective view schematically illustrating a part of the configuration of the shielding mechanism of one embodiment. FIG. 14 includes plan views schematically illustrating the configuration of the shielding mechanism of one embodiment. FIG. 14A illustrates a state where the shielding member 481 is at the retracted position, and FIG. 14B illustrates a state where the shielding member 481 is at the shielding position.

As illustrated in FIG. 11 to FIG. 14, the shielding mechanism 485 includes a belt 492 wound around a first pulley 492-1 and a second pulley 492-2, and a rotation drive mechanism 491 configured to rotate the belt 492 by rotating the first pulley 492-1. The rotation drive mechanism 491 can be achieved by a known mechanism, such as a rotation motor. The shielding mechanism 485 includes an eccentric cam member 493 as one configuration of a cam member coupled to the second pulley 492-2. The eccentric cam member 493 is configured to rotate about a rotation shaft 493*a* in association with the rotation of the second pulley 492-2. The shielding mechanism 485 includes a driven cam member 494 as one configuration of a driven member configured to push out the shielding member 481 to the shielding position in response to pressing by a protrusion 493*b* of the eccentric cam member 493. Specifically, a bracket 495-1 is attached to the driven cam member 494, and shafts 495-2 extending in the horizontal direction are attached to the bracket 495-1. Linear motion guides 496 are attached to the shafts 495-2. The shielding member 481 is attached to the shafts 495-2 via the plate-shaped bracket 483 extending in the vertical direction.

With this, as illustrated in FIG. 14B, when the eccentric cam member 493 rotates to press the driven cam member 494 to a first direction by the protrusion 493*b* of the eccentric cam member 493, the shielding member 481 is pushed out to the shielding position via the shafts 495-2 and the bracket 483. When the rotation drive mechanism 491 stops the rotation of the eccentric cam member 493 in this state, the shielding member 481 remains to be moved to the shielding position. On the other hand, the driven cam member 494 is configured to be pushed back to a second direction opposite to the first direction when the driven cam member 494 is not pressed by the protrusion 493*b* of the eccentric cam member 493. With this, as illustrated in FIG. 14A, once the eccentric cam member 493 further rotates to release the pressing of the driven cam member 494 by the protrusion 493*b* of the eccentric cam member 493, the shielding member 481 is pushed back to the retracted position.

The rotation drive mechanism 491 is configured to rotate the first pulley 492-1 depending on the rotation angle of the substrate holder 440. That is, similarly to the above-described embodiment, for example, the rotation drive mechanism 491 can rotate the first pulley 492-1 so as to push out the shielding member 481 to the shielding position when the specific portion α of the substrate Wf rotates within the predetermined angle range. This allows for covering the specific portion α of the substrate Wf by the shielding member 481. Further, the rotation drive mechanism 491 can rotate the first pulley 492-1 so as to cause the shielding member 481 to return to the retracted position when the specific portion α rotates outside the predetermined angle range. With this embodiment, the specific portion α can be covered with the shielding member 481 at a desired timing instead of constantly covering the specific portion α with the shielding member 481. Additionally, the rotation mechanism 447 can switch the rotation direction of the substrate holder 440 between the first direction and the second direction when the specific portion α of the substrate Wf is within the predetermined range of the rotation angle. Accordingly, since the period of shielding the electric field in the specific portion α can be appropriately controlled, and the stirring strength of the plating solution can be enhanced, the plating film-thickness can be made uniform.

Figure 15:
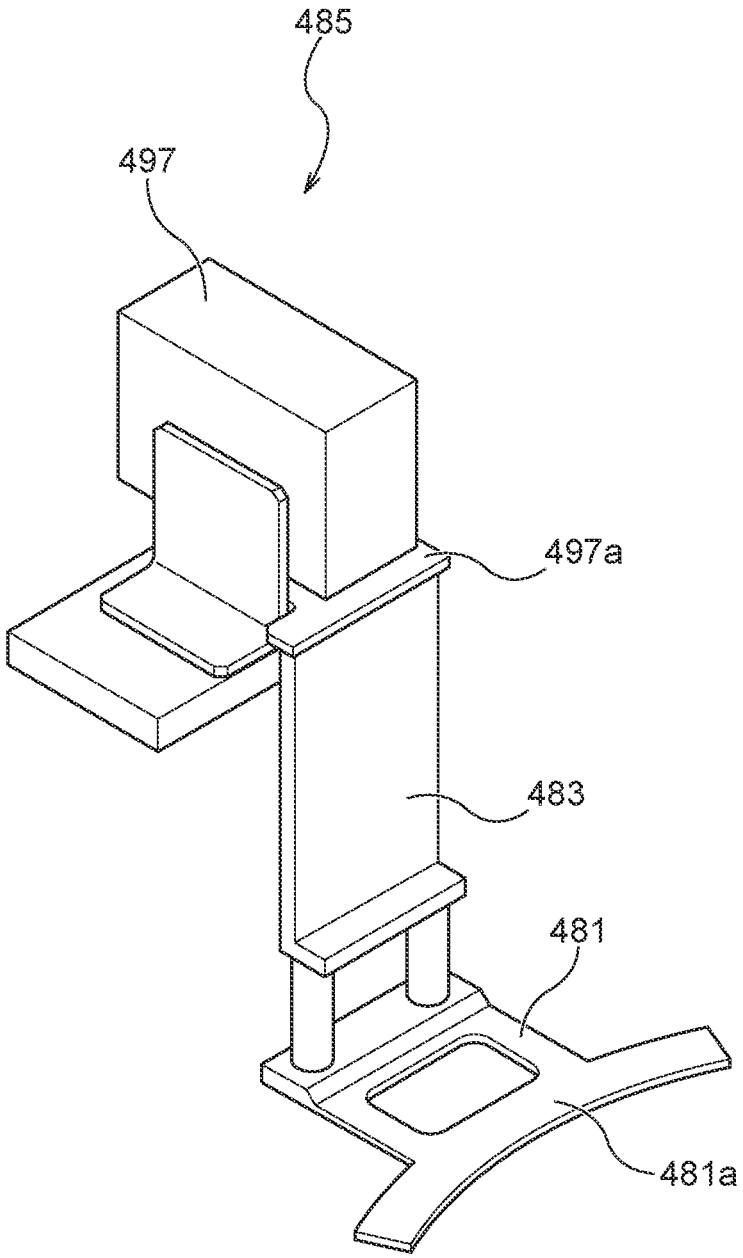
FIG. 15 is a perspective view schematically illustrating the configuration of the shielding mechanism of one embodiment.
Figure 16:
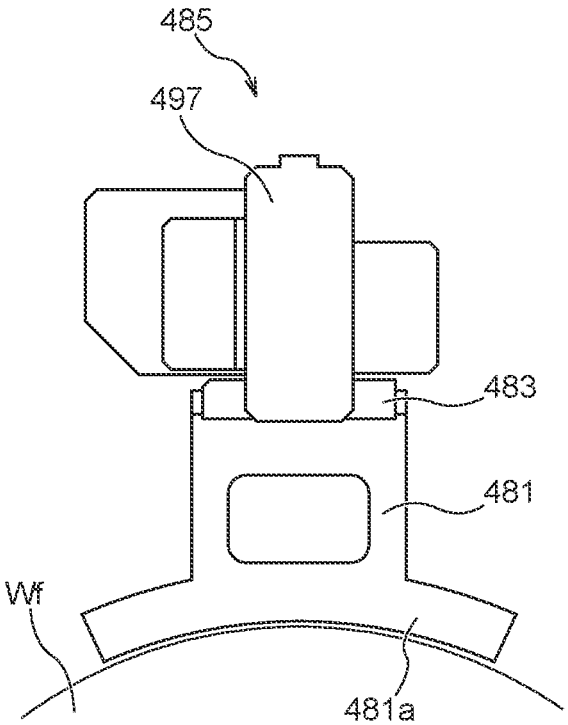
FIG. 16 includes plan views schematically illustrating the configuration of the shielding mechanism of one embodiment.
Figure 16:
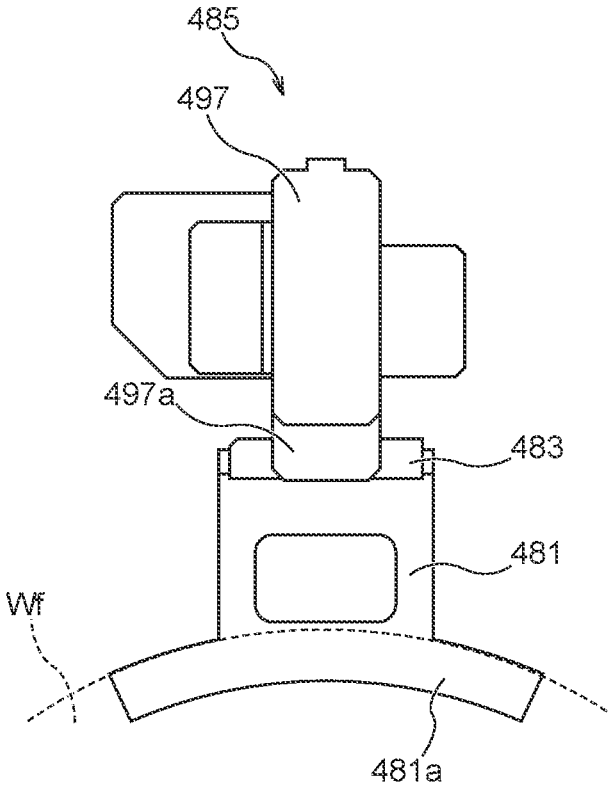

FIG. 15 is a perspective view schematically illustrating the configuration of the shielding mechanism of one embodiment. FIG. 16 includes plan views schematically illustrating the configuration of the shielding mechanism of one embodiment. FIG. 16A illustrates a state where the shielding member 481 is at the retracted position, and FIG. 16B illustrates a state where the shielding member 481 is at the shielding position.

As illustrated in FIG. 15 and FIG. 16, the shielding mechanism 485 includes a linear motion drive mechanism 497 configured to linearly move the shielding member 481 between the shielding position and the retracted position. Specifically, the linear motion drive mechanism 497 includes a slider 497*a* configured to reciprocate in the horizontal direction in response to driving of the linear motion drive mechanism 497. The shielding member 481 is attached to the slider 497*a* via the plate-shaped bracket 483 extending in the vertical direction. The shielding member 481 can be linearly moved between the shielding position and the retracted position by driving the linear motion drive mechanism 497. The linear motion drive mechanism 497 can be achieved by a known mechanism, such as a linear motion motor.

The linear motion drive mechanism 497 is configured to linearly move the shielding member 481 between the shielding position and the retracted position depending on the rotation angle of the substrate holder 440. That is, similarly to the above-described embodiments, for example, the linear motion drive mechanism 497 is configured to push out the shielding member 481 to the shielding position when the specific portion α of the substrate Wf rotates within the predetermined angle range. This allows for covering the specific portion α of the substrate Wf by the shielding member 481. Further, the linear motion drive mechanism 497 is configured to cause the shielding member 481 to return to the retracted position when the specific portion α rotates outside the predetermined angle range. With this embodiment, the specific portion α can be covered with the shielding member 481 at a desired timing instead of constantly covering the specific portion α with the shielding member 481. Additionally, the rotation mechanism 447 can switch the rotation direction of the substrate holder 440 between the first direction and the second direction when the specific portion α of the substrate Wf is within the predetermined range of the rotation angle. Accordingly, since the period of shielding the electric field in the specific portion α can be appropriately controlled, and the stirring strength of the plating solution can be enhanced, the plating film-thickness can be made uniform.

Figure 17:
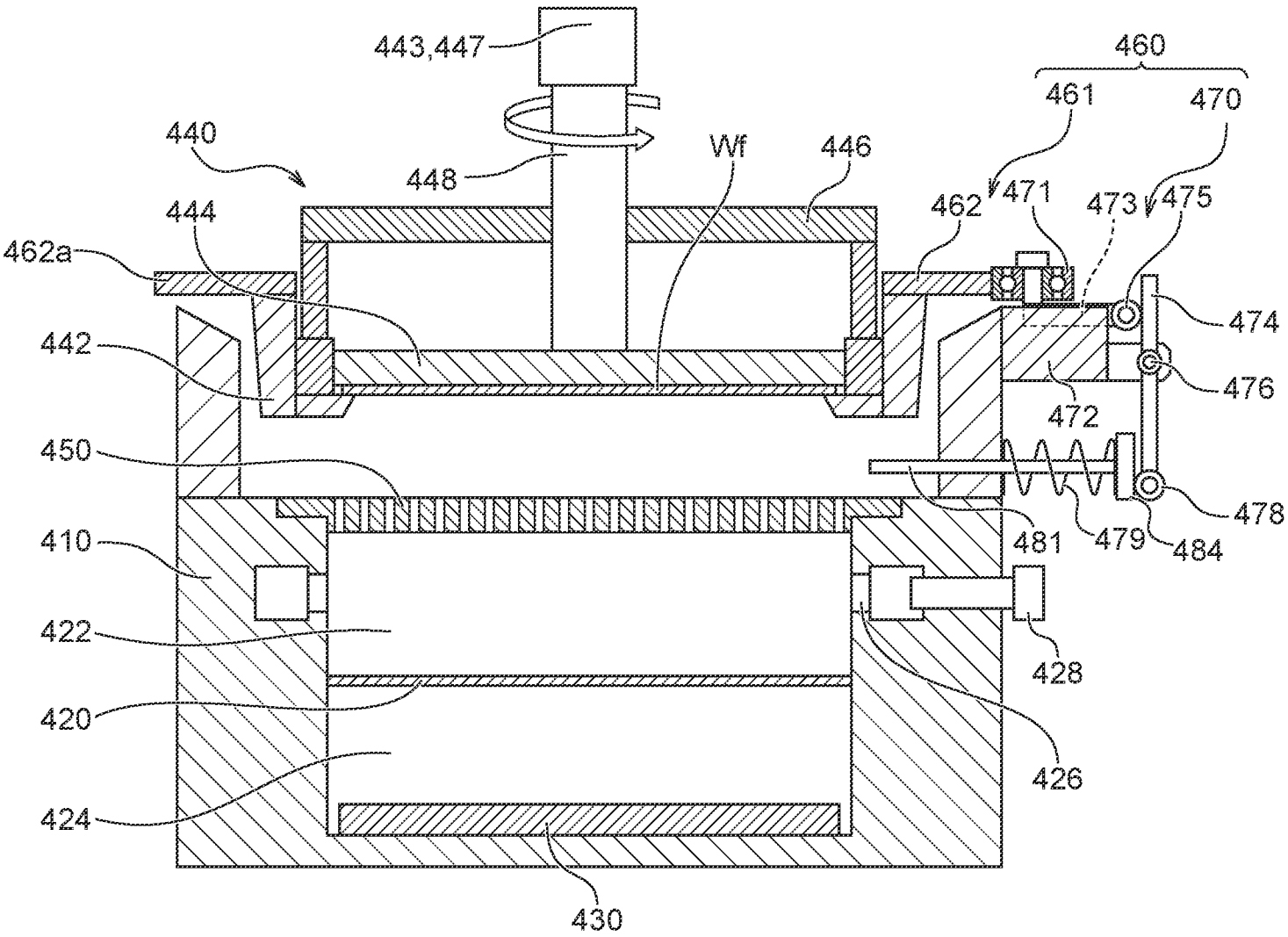
FIG. 17 is a vertical cross-sectional view schematically illustrating a configuration of a plating module of one embodiment, and illustrates a state where a shielding member is retracted.

While in the above-described embodiments, the example in which the shielding mechanism 485 is configured to operate in response to the command signal based on information regarding the rotation angle of the substrate holder 440 input from the control module 800 is described, it is not limited to this. FIG. 17 is a vertical cross-sectional view schematically illustrating a configuration of a plating module of one embodiment, and illustrates a state where a shielding member is retracted.

As illustrated in FIG. 17, the plating module 400 includes a shielding member 481 for shielding an electric field formed between the anode 430 and the substrate Wf when arranged between the anode 430 and the substrate Wf. The shielding member 481 may be, for example, a shielding plate formed in a plate shape. The shielding member 481 is inserted into the cathode region 422 passing through a side wall of the plating tank 410, and a flange 484 is attached to an end portion in a side not inserted into the plating tank 410. In this embodiment, the shielding member 481 is configured to shield a specific portion of the substrate Wf at a desired timing instead of being constantly arranged between the anode 430 and the substrate Wf. The following describe this respect.

Figure 18:
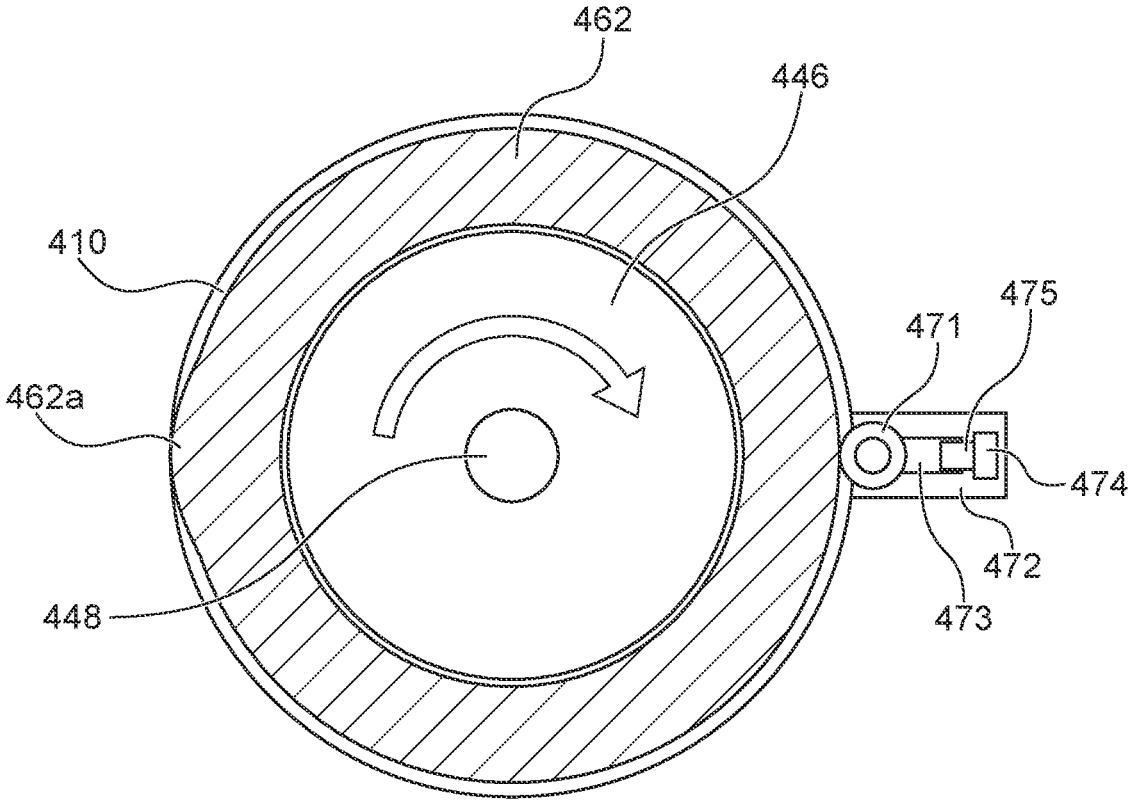
FIG. 18 is a top view schematically illustrating the configuration of the plating module of one embodiment, and illustrates the state where the shielding member is retracted.

FIG. 18 is a top view schematically illustrating the configuration of the plating module of one embodiment, and illustrates the state where the shielding member is retracted. As illustrated in FIG. 17 and FIG. 18, the plating module 400 includes the shielding mechanism 460 configured to move the shielding member 481 to the shielding position corresponding to the rotation angle of the substrate holder 440 by the rotation mechanism 447. The shielding mechanism 460 includes a cam member 461 attached to the substrate holder 440. The cam member 461 includes a disc cam 462 attached to an upper surface of the seal ring holder 442. The shielding mechanism 460 includes a driven link 470 configured to push out the shielding member 481 into between the anode 430 and the substrate Wf in response to pressing by a protrusion 462*a* of the cam member 461 (disc cam 462).

The driven link 470 includes a follower 473 that is pressed by the protrusion 462*a* of the disc cam 462 to move to a direction moving away from the substrate holder 440. A base 472 is attached on an outer wall surface at an upper portion of the plating tank 410, and the follower 473 is supported by the base 472 so as to be able to reciprocate in a radiation direction centering around the shaft 448. The follower 473 is a rod-shaped member extending in the radiation direction centering around the shaft 448. The follower 473 has one end portion to which a first roller 471 that rotates about an axis parallel to the rotation axis of the shaft 448 is attached. The follower 473 has the other end portion to which a second roller 475 that is rotatable about an axis perpendicular to both a direction of the rotation axis of the shaft 448 and the radiation direction centering around the shaft 448 is attached.

The driven link 470 includes a link 474 that rotates in response to a pressing by the follower 473 to push out the shielding member 481 into between the anode 430 and the substrate Wf. The link 474 is a rod-shaped member and rotatably supported by the base 472 about a rotation shaft 476 disposed in the base 472. The rotation shaft 476 is a rotation shaft parallel to a rotation axis of the second roller 475. The link 474 is supported by the base 472 so that one side of the link 474 across the rotation shaft 476 can come in contact with the second roller 475. To an end portion on the other side of the link 474 across the rotation shaft 476, a third roller 478 that is rotatable about an axis parallel to the rotation axis of the second roller 475 is attached. The link 474 is supported by the base 472 so that the third roller 478 can come in contact with the flange 484 of the shielding member 481.

The driven link 470 includes a pressing member 479 that pushes the shielding member 481 back to the retracted position when the shielding member 481 is not pushed out by the link 474. While the pressing member 479 is, for example, a helical compression spring having one end portion attached to an outer wall of the plating tank 410 and the other end portion attached to the flange 484 of the shielding member 481, the pressing member 479 is not limited to this.

Next, an operation of the shielding member 481 by the shielding mechanism 460 will be described. As illustrated in FIG. 17 and FIG. 18, when the protrusion 462*a* of the disc cam 462 does not press the first roller 471, the flange 484 is pressed to the direction moving away from the plating tank 410 by a biasing force of the pressing member 479. This causes the shielding member 481 to move to the retracted position. Further, when the flange 484 is pressed to the direction moving away from the plating tank 410, the flange 484 presses the third roller 478, thereby rotating the link 474 counterclockwise. Then, the one side of the link 474 across the rotation shaft 476 presses the second roller 475 toward the center of the shaft 448. This causes the follower 473 to move toward the center of the shaft 448.

Figure 19:
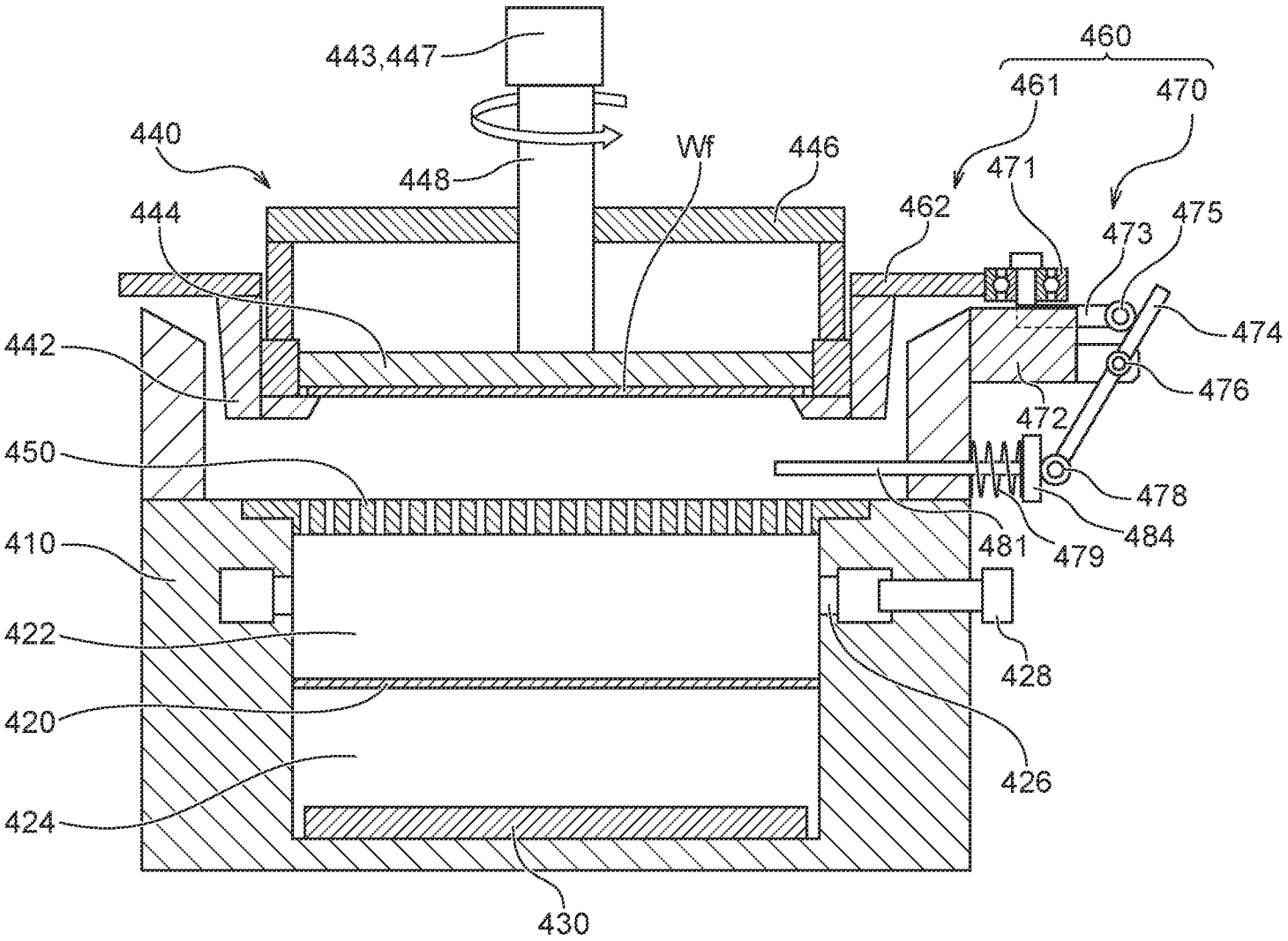
FIG. 19 is a vertical cross-sectional view schematically illustrating the configuration of the plating module of one embodiment, and illustrates a state where the shielding member is moved into between an anode and a substrate.
Figure 20:
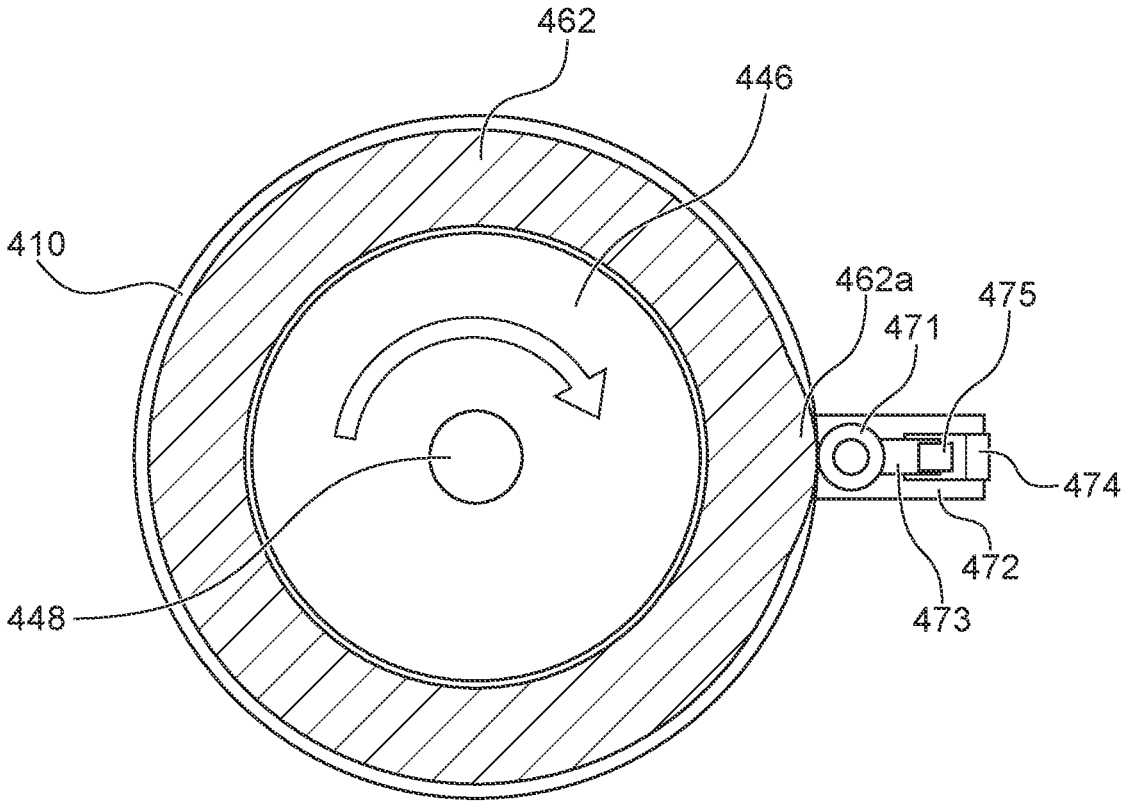
FIG. 20 is a top view schematically illustrating the configuration of the plating module of one embodiment, and illustrates the state where the shielding member is moved into between the anode and the substrate.

FIG. 19 is a vertical cross-sectional view schematically illustrating the configuration of the plating module of one embodiment, and illustrates a state where the shielding member is moved into between an anode and a substrate. FIG. 20 is a top view schematically illustrating the configuration of the plating module of one embodiment, and illustrates the state where the shielding member is moved into between the anode and the substrate. As illustrated in FIG. 19 and FIG. 20, when the substrate holder 440 rotates and lies within the range of a predetermined rotation angle, the protrusion 462*a* of the disc cam 462 presses the first roller 471, thereby moving the first roller 471 to a direction moving away from the center of the shaft 448. In accordance with this, the follower 473 moves to the direction moving away from the center of the shaft 448 and the second roller 475 presses the one side of the link 474 across the rotation shaft 476. This causes the link 474 to rotate clockwise, and the third roller 478 presses the flange 484 to a direction approaching the plating tank 410 against the biasing force of the pressing member 479. As a result, the shielding member 481 is pushed out into between the anode 430 and the substrate Wf. When the substrate holder 440 rotates beyond the predetermined range of the rotation angle, the shielding member 481 moves to the retracted position as described using FIG. 17 and FIG. 18.

The embodiment includes the shielding mechanism 460 configured to move the shielding member 481 into between the anode 430 and the substrate Wf depending on the rotation angle of the substrate holder 440 instead of constantly arranging the shielding member 481 between the anode 430 and the substrate Wf. Accordingly, the specific portion $\alpha$ of the substrate Wf to be covered with the shielding member 481 can be shielded at the desired timing. Additionally, the rotation mechanism 447 is configured switch the rotation direction of the substrate holder 440 between the first direction and the second direction when the specific portion $\alpha$ of the substrate Wf is within the predetermined range of the rotation angle. Accordingly, since the period of shielding the electric field in the specific portion $\alpha$ can be appropriately controlled, and the stirring strength of the plating solution can be enhanced, the plating film-thickness can be made uniform.

While the example in which one protrusion 462*a* of the disc cam 462 is disposed is described in this embodiment, it is not limited to this, and for example, when a plurality of specific portions of the substrate Wf are provided along the circumferential direction of the substrate Wf, a plurality of protrusions 462*a* of the disc cam 462 may be disposed corresponding to the arrangement of the specific portions of the substrate Wf. While the example in which one shielding mechanism 460 is disposed is described in this embodiment, it is not limited to this, and a plurality of shielding mechanisms 460 may be disposed along the circumferential direction of the plating tank 410. This allows covering the specific portion of the substrate Wf with the shielding member 481 when the specific portion of the substrate Wf is within a plurality of different predetermined ranges of the rotation angle.

Figure 21:
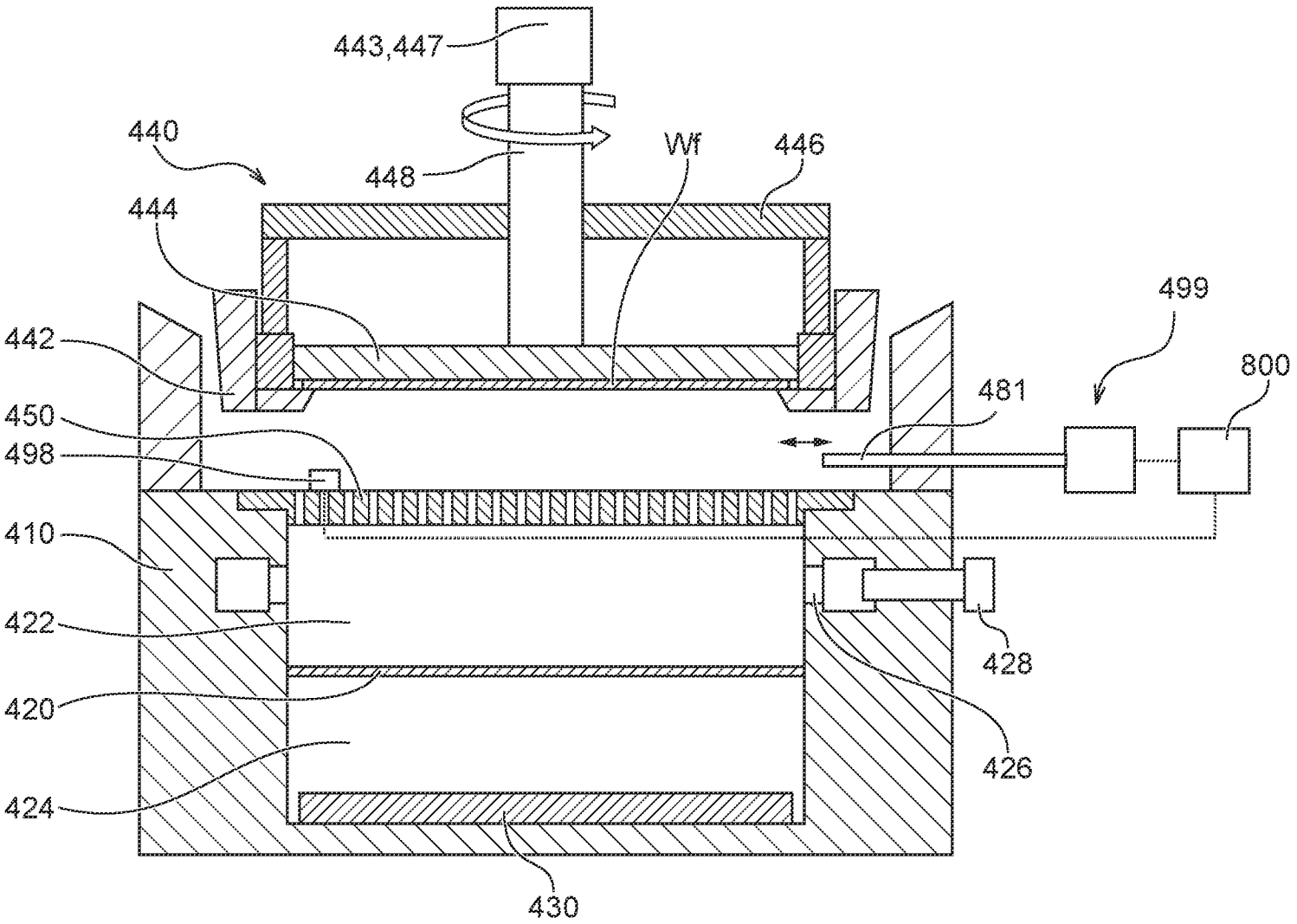
FIG. 21 is a vertical cross-sectional view schematically illustrating a configuration of a plating module of one embodiment.

FIG. 21 is a vertical cross-sectional view schematically illustrating a configuration of a plating module of one embodiment. The same reference numerals are attached to configurations similar to those in the embodiments indicated by FIG. 3 to FIG. 20, and the repeated explanation will be omitted.

As illustrated in FIG. 21, the plating module 400 includes a film thickness sensor 498 configured to measure the plating film-thickness of the substrate Wf, and a shielding mechanism 499 configured to move the shielding member 481 to the shielding position based on the plating film-thickness of the substrate Wf measured by the film thickness sensor 498. The shielding mechanism 499 is configured to operate in response to a command signal based on information regarding the plating film-thickness of the substrate Wf input from the control module 800. The shielding mechanism 499 may have a structure similar to that of any of the shielding mechanisms 485 illustrated in FIG. 5 to FIG. 16.

The film thickness sensor 498 is configured to measure the plating film-thickness of the peripheral edge portion of the surface to be plated of the substrate Wf. The film thickness sensor 498 is attached to the ionically resistive element 450 so as to be opposed to the peripheral edge portion of the substrate Wf. The film thickness sensor 498 can measure the plating film-thickness by scanning the peripheral edge portion while the substrate Wf rotates once. However, the film thickness sensor 498 may be configured to measure the plating film-thickness of the whole surface to be plated of the substrate Wf. For example, the film thickness sensor 498 can employ a distance sensor that measures a distance between the film thickness sensor 498 and the substrate Wf (plating film) or a displacement sensor that measures a displacement of the surface to be plated of the substrate Wf. As the film thickness sensor 498, a sensor for estimating a formation speed of the plating film-thickness may be employed. As the film thickness sensor 498, for example, an optical sensor, such as a white light confocal sensor, a potential sensor, a magnetic field sensor, or an eddy current sensor are usable.

The shielding mechanism 499 is configured to linearly move the shielding member 481 between the retracted position and the shielding position so as to make the plating film-thickness of the peripheral edge portion of the substrate Wf uniform. Specifically, the shielding mechanism 499 is configured to move the shielding member 481 to the retracted position when the rotation angle of a region having a thick plating film-thickness is out of the predetermined range in a case where there is the region having the thick plating film-thickness compared with other regions in the distribution of the plating film-thickness of the peripheral edge portion of the substrate Wf. The shielding mechanism 499 is configured to move the shielding member 481 to the shielding position when the rotation angle of the region having the thick plating film-thickness is within the predetermined range. Accordingly, with this embodiment, the region having the thick plating film-thickness of the substrate Wf can be covered with the shielding member 481.

Additionally, the rotation mechanism 447 can switch the rotation direction of the substrate holder 440 between the first direction and the second direction when the region having the thick plating film-thickness is within the predetermined range of the rotation angle. That is, when there is a region having a significantly thick plating film-thickness compared with other regions of the surface to be plated, only moving the shielding member 481 to the shielding position while rotating the substrate holder 440 at a predetermined constant speed possibly fails to sufficiently eliminate unevenness in both plating film-thicknesses. In such a case, by switching the rotation direction of the substrate holder 440, since the period of shielding the electric field in the region having the thick plating film-thickness can be appropriately controlled, and the stirring strength of the plating solution can be enhanced, the plating film-thickness can be made uniform.

Figure 22:
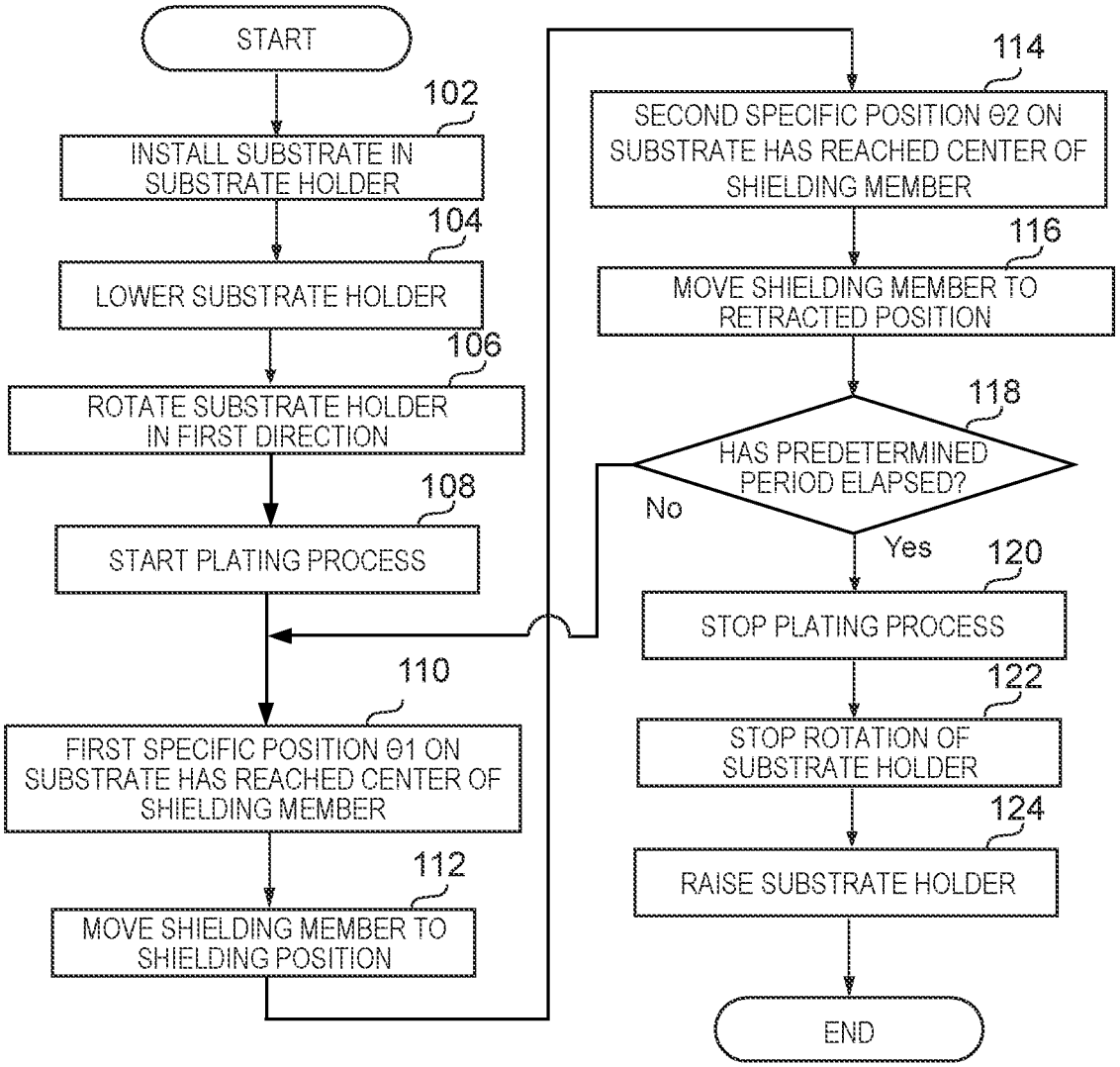
FIG. 22 is a flowchart of a plating method using the plating module of one embodiment.

Next, a plating method using the plating module 400 of the embodiment will be described. FIG. 22 is a flowchart of a plating method using the plating module of one embodiment. The following describes a plating method in which the rotation direction of the substrate holder 440 is not switched as illustrated in FIG. 8 as an example.

In the plating method, the substrate Wf is installed in the substrate holder 440 (Step 102). Step 102 can be performed by, for example, placing the substrate Wf with the surface to be plated Wf-a facing downward on the seal ring holder 442 with a robot hand (not illustrated) and the like and pressing the back surface of the substrate Wf by the back plate 444.

Subsequently, in the plating method, the substrate holder 440 is lowered into the plating tank 410 by the elevating mechanism 443 (lowering step 104). Subsequently, in the plating method, the substrate holder 440 is rotated in the first direction by the rotation mechanism 447 (first rotating step 106).

Subsequently, in the plating method, the plating process is performed on the surface to be plated Wf-a by applying a voltage between the anode 430 arranged in the plating tank 410 and the substrate Wf held by the substrate holder 440 (plating step 108).

Subsequently, in the plating method, when a first specific position θ1 of the substrate Wf reaches the center of the shielding member 481 (Step 110), the shielding member 481 is moved to the shielding position (shielding step 112).

Subsequently, in the plating method, when a second specific position θ2 of the substrate Wf reaches the center of the shielding member 481 (Step 114), the shielding member 481 is moved to the retracted position (retracting step 116).

Subsequently, in the plating method, whether to end the plating process or not is determined (Step 118). In the plating method, for example, when it is determined that the plating process is not to be ended because a predetermined time has not elapsed after the start of the plating process (Step 118, No), the process returns to Step 110 and is continued.

Meanwhile, in the plating method, for example, when it is determined that the plating process is to be ended because the predetermined time has elapsed after the start of the plating process (Step 118, Yes), the voltage application between the anode 430 and the substrate Wf is stopped, thereby stopping the plating process (Step 120). Subsequently, in the plating method, the rotation of the substrate holder 440 by the rotation mechanism 447 is stopped (Step 122). Subsequently, in the plating method, the substrate holder 440 is raised by the elevating mechanism 443 (Step 124). Thus, a sequence of the plating process ends.

Figure 23:
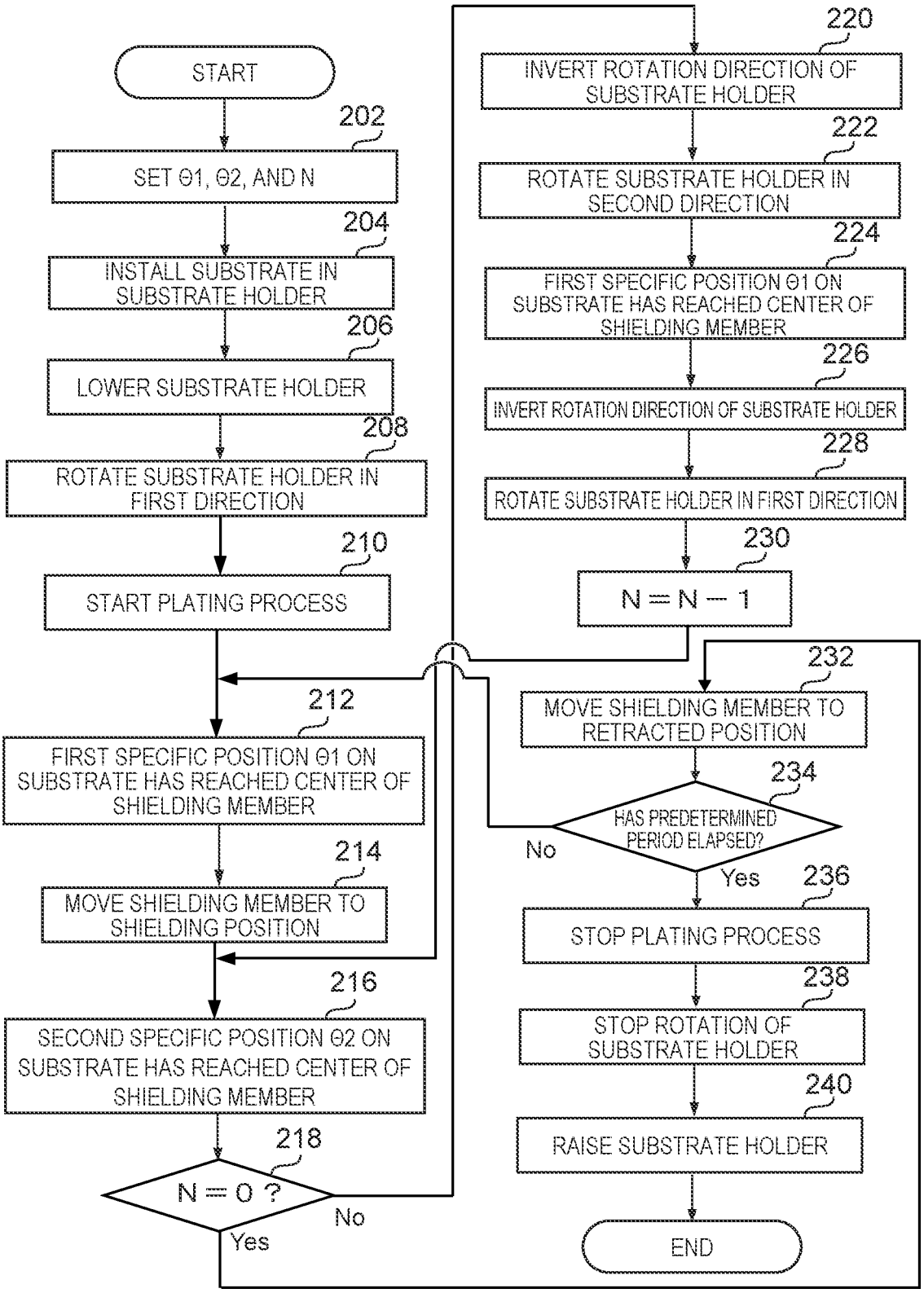
FIG. 23 is a flowchart of a plating method using the plating module of one embodiment.

Next, another plating method using the plating module 400 of the embodiment will be described. FIG. 23 is a flowchart of a plating method using the plating module of one embodiment. The following describes a plating method in which the rotation direction of the substrate holder 440 is switched several times as illustrated in FIG. 9 and FIG. 10.

In the plating method, a first specific position θ1 and a second specific position θ2 of the substrate Wf, and a number N of repeating the additional suppression of the deposition rate of plating are set (Step 202). Values of θ1, θ2, and the number N of repeating the additional suppression are preferably estimated using an electric field analysis based on the shape of the shielding member 481, the shape of the specific portion α, and the intensity necessary for suppressing the deposition rate of plating. A plurality of regions in which the deposition rate of plating needs to be suppressed are present in one substrate in some cases. In this case, θ1, θ2, and the number N of repeating the additional suppression are set for each region.

Subsequently, the substrate Wf is installed in the substrate holder 440 (Step 204). Subsequently, in the plating method, the substrate holder 440 is lowered into the plating tank 410 by the elevating mechanism 443 (lowering step 206). Subsequently, in the plating method, the substrate holder 440 is rotated in the first direction by the rotation mechanism 447 (first rotating step 208).

Subsequently, in the plating method, the plating process is performed on the surface to be plated Wf-a by applying a voltage between the anode 430 arranged in the plating tank 410 and the substrate Wf held by the substrate holder 440 (plating step 210).

Subsequently, in the plating method, when a first specific position θ1 of the substrate Wf reaches the center of the shielding member 481 (Step 212), the shielding member 481 is moved to the shielding position (shielding step 214).

Subsequently, in the plating method, when a second specific position θ2 of the substrate Wf reaches the center of the shielding member 481 (Step 216), whether N is N=0 or not is determined (Step 218). In the plating method, when N is determined not to be N=0 (Step 218, No), the rotation direction of the substrate holder 440 is switched between the first direction and the second direction (inverting step 220). Specifically, in the inverting step 220, the rotation speed of the substrate holder 440 is decreased, and the rotation direction of the substrate holder 440 is switched to the second direction.

Subsequently, in the plating method, the substrate holder 440 is rotated in the second direction by the rotation mechanism 447 (second rotating step 222). Subsequently, in the plating method, when the first specific position θ1 of the substrate Wf reaches the center of the shielding member 481 (Step 224), the rotation direction of the substrate holder 440 is switched between the first direction and the second direction (inverting step 226). Specifically, in the inverting step 226, the rotation speed of the substrate holder 440 is decreased, and the rotation direction of the substrate holder 440 is switched to the first direction.

Subsequently, in the plating method, the substrate holder 440 is rotated in the first direction by the rotation mechanism 447 (first rotating step 228). Subsequently, in the plating method, N is decremented (value of N is decreased by 1) (Step 230). Subsequently, in the plating method, the process returns to Step 216 and is continued. Thus, the additional suppression of the deposition rate of plating in the specific portion α of the substrate Wf is repeated.

Meanwhile, in the plating method, when N is determined to be N=0 (Step 218, Yes), the shielding member 481 is moved to the retracted position (retracting step 232). Subsequently, in the plating method, whether to end the plating process or not is determined (Step 234). In the plating method, for example, when it is determined that the plating process is not to be ended because a predetermined time has not elapsed after the start of the plating process (Step 234, No), the process returns to Step 212 and is continued.

Meanwhile, in the plating method, for example, when it is determined that the plating process is to be ended because the predetermined time has elapsed after the start of the plating process (Step 234, Yes), the voltage application between the anode 430 and the substrate Wf is stopped, thereby stopping the plating process (Step 236). Subsequently, in the plating method, the rotation of the substrate holder 440 by the rotation mechanism 447 is stopped (Step 238). Subsequently, in the plating method, the substrate holder 440 is raised by the elevating mechanism 443 (Step 240). Thus, a sequence of the plating process ends.

With the plating method of the embodiment, the specific portion of the substrate Wf can be covered with the shielding member 481 at a desired timing. Additionally, the rotation direction of the substrate holder 440 is switched between the first direction and the second direction when the specific portion of the substrate Wf is within the predetermined range of the rotation angle. Accordingly, since the period of shielding the electric field in the specific portion of the substrate Wf can be appropriately controlled, and the stirring strength of the plating solution can be enhanced, the plating film-thickness of the surface to be plated can be made uniform.

While some embodiments of the present invention have been described above, the above-described embodiments of the invention are for ease of understanding the present invention, and are not for limiting the present invention. It is obvious that the present invention can be changed or improved without departing from its gist, and that the present invention encompasses its equivalents. Within a range that can solve at least a part of the above-described problems or a range that provides at least a part of the effects, any combination or omission of each component described in the claim and the description are allowed.

This application discloses, as one embodiment, a plating apparatus that includes: a plating tank for housing a plating solution; an anode disposed in the plating tank; a substrate holder for holding a substrate with a surface to be plated facing downward; a rotation mechanism configured to rotate the substrate holder in a first direction and a second direction opposite to the first direction; and a shielding mechanism configured to move a shielding member into between the anode and the substrate depending on a rotation angle of the substrate holder.

Furthermore, this application discloses, as one embodiment, the plating apparatus in which the shielding mechanism is configured to move the shielding member into between the anode and a specific portion of the substrate when a rotation angle of the specific portion of the substrate held by the substrate holder is within a predetermined range, and the rotation mechanism is configured to switch a rotation direction of the substrate holder between the first direction and the second direction when the rotation angle of the specific portion of the substrate is within a predetermined range.

Furthermore, this application discloses, as one embodiment, the plating apparatus in which the rotation mechanism is configured to switch the rotation direction of the substrate holder between the first direction and the second direction several times when the rotation angle of the specific portion of the substrate is within the predetermined range.

Furthermore, this application discloses, as one embodiment, the plating apparatus in which the shielding mechanism includes a cam member, a rotation drive mechanism configured to rotate the cam member, and a driven member configured to push out the shielding member to a shielding position between the anode and the substrate in association with the rotation of the cam member.

Furthermore, this application discloses, as one embodiment, the plating apparatus in which the cam member includes a cam main body configured to be rotated by the rotation drive mechanism, and a rotor attached to the cam main body, and the driven member includes a driven slider provided with a cam groove in which the rotor is fitted, the driven slider is configured to linearly move the shielding member between the shielding position and a retracted position apart from between the anode and the substrate by a pressing from the rotor in association with the rotation of the cam main body.

Furthermore, this application discloses, as one embodiment, the plating apparatus in which the shielding mechanism further includes a belt wound around a first pulley and a second pulley, the cam member includes an eccentric cam member coupled to the second pulley, the rotation drive mechanism is configured to rotate the eccentric cam member by rotating the first pulley, and the driven member includes a driven cam member configured to push out the shielding member to the shielding position in response to a pressing by a protrusion of the eccentric cam member.

Furthermore, this application discloses, as one embodiment, the plating apparatus in which the shielding mechanism includes a linear motion drive mechanism configured to linearly move the shielding member between a shielding position and a retracted position, the shielding position is between the anode and the substrate, the retracted position is apart from between the anode and the substrate.

Furthermore, this application discloses, as one embodiment, the plating apparatus in which the shielding mechanism includes: a cam member attached to the substrate holder, and a driven link configured to push out the shielding member into between the anode and the substrate in response to a pressing by a protrusion of the cam member.

Furthermore, this application discloses, as one embodiment, a plating method that includes: a lowering step of lowering a substrate holder holding a substrate with a surface to be plated facing downward in a plating tank; a plating step of performing a plating process on the surface to be plated of the substrate lowered in the plating tank; a first rotating step of rotating the substrate holder in a first direction; a second rotating step of rotating the substrate holder in a second direction opposite to the first direction; and a shielding step of moving a shielding member into between an anode and a substrate depending on a rotation angle of the substrate holder.

Furthermore, this application discloses, as one embodiment, the plating method in which the shielding step is configured to move the shielding member into between the anode and a portion of the substrate when a rotation angle of a specific portion of the substrate held by the substrate holder is within a predetermined range, and the method further includes an inverting step of switching a rotation direction of the substrate holder between the first direction and the second direction when the rotation angle of the specific portion of the substrate is within a predetermined range.

Furthermore, this application discloses, as one embodiment, the plating method in which the inverting step is configured to switch the rotation direction of the substrate holder between the first direction and the second direction several times when the rotation angle of the specific portion of the substrate is within the predetermined range.

REFERENCE SIGNS LIST

400 . . . plating module
410 . . . plating tank
430 . . . anode
440 . . . substrate holder
443 . . . elevating mechanism
447 . . . rotation mechanism
460, 485, 499 . . . shielding mechanism
461 . . . cam member
470 . . . driven link
481 . . . shielding member
486, 491 . . . rotation drive mechanism
487 . . . cam member
488 . . . driven member
492 . . . belt
492-1 . . . first pulley
492-2 . . . second pulley
493 . . . eccentric cam member
494 . . . driven cam member
497 . . . linear motion drive mechanism
1000 . . . plating apparatus
Wf . . . substrate
Wf-a . . . surface to be plated

The invention claimed is:

1. A plating apparatus comprising:
a plating tank for housing a plating solution;
an anode disposed in the plating tank;
a substrate holder for holding a substrate with a surface to be plated facing downward;
a rotation mechanism configured to rotate the substrate holder in a first direction and a second direction opposite to the first direction; and
a shielding mechanism configured to move a shielding member into between the anode and the substrate depending on a rotation angle of the substrate holder, wherein the shielding mechanism is configured to move the shielding member into between the anode and a specific portion of the substrate when a rotation angle of the specific portion of the substrate held by the substrate holder is within a predetermined range, and
the rotation mechanism is configured to switch a rotation direction of the substrate holder between the first direction and the second direction when the rotation angle of the specific portion of the substrate is within a predetermined range.

2. The plating apparatus according to claim 1, wherein
the rotation mechanism is configured to switch the rotation direction of the substrate holder between the first direction and the second direction several times when the rotation angle of the specific portion of the substrate is within the predetermined range.

3. A plating apparatus comprising:
a plating tank for housing a plating solution;
an anode disposed in the plating tank;
a substrate holder for holding a substrate with a surface to be plated facing downward;
a rotation mechanism configured to rotate the substrate holder in a first direction and a second direction opposite to the first direction; and
a shielding mechanism configured to move a shielding member into between the anode and the substrate depending on a rotation angle of the substrate holder, wherein
the shielding mechanism includes a cam member, a rotation drive mechanism configured to rotate the cam member, and a driven member configured to push out the shielding member to a shielding position between the anode and the substrate in association with the rotation of the cam member.

4. The plating apparatus according to claim 3, wherein
the cam member includes a cam main body configured to be rotated by the rotation drive mechanism, and a rotor attached to the cam main body, and
the driven member includes a driven slider provided with a cam groove in which the rotor is fitted, the driven slider is configured to linearly move the shielding member between the shielding position and a retracted position apart from between the anode and the substrate by a pressing from the rotor in association with the rotation of the cam main body.

5. The plating apparatus according to claim 3, wherein the shielding mechanism further includes a belt wound around a first pulley and a second pulley, the cam member includes an eccentric cam member coupled to the second pulley, the rotation drive mechanism is configured to rotate the eccentric cam member by rotating the first pulley, and the driven member includes a driven cam member configured to push out the shielding member to the shielding position in response to a pressing by a protrusion of the eccentric cam member.

6. A plating apparatus comprising:

a plating tank for housing a plating solution;

an anode disposed in the plating tank;

a substrate holder for holding a substrate with a surface to be plated facing downward;

a rotation mechanism configured to rotate the substrate holder in a first direction and a second direction opposite to the first direction; and a shielding mechanism configured to move a shielding member into between the anode and the substrate depending on a rotation angle of the substrate holder, wherein the shielding mechanism includes a linear motion drive mechanism configured to linearly move the shielding member between a shielding position and a retracted position, the shielding position is between the anode and the substrate, the retracted position is apart from between the anode and the substrate.

7. A plating apparatus comprising:

a plating tank for housing a plating solution;

an anode disposed in the plating tank;

a substrate holder for holding a substrate with a surface to be plated facing downward;

a rotation mechanism configured to rotate the substrate holder in a first direction and a second direction opposite to the first direction; and a shielding mechanism configured to move a shielding member into between the anode and the substrate depending on a rotation angle of the substrate holder, wherein the shielding mechanism includes:

a cam member attached to the substrate holder, and a driven link configured to push out the shielding member into between the anode and the substrate in response to a pressing by a protrusion of the cam member.

* * * * *